US012352480B2

(12) United States Patent
Han et al.

(10) Patent No.: US 12,352,480 B2
(45) Date of Patent: Jul. 8, 2025

(54) AIR CONDITIONER WITH DEFROSTING OPERATION AND METHOD FOR CONTROLLING THE SAME

(71) Applicant: SAMSUNG ELECTRONICS CO., LTD., Suwon-si (KR)

(72) Inventors: Kwangsik Han, Suwon-si (KR); Sangho Yoo, Suwon-si (KR); Jaeyang Lee, Suwon-si (KR); Jejin Lee, Suwon-si (KR); Hyeongseok Lim, Suwon-si (KR); Byoungguk Lim, Suwon-si (KR); Yonghee Jang, Suwon-si (KR); Gwangchel Jeong, Suwon-si (KR); Dongil Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 257 days.

(21) Appl. No.: 18/086,270

(22) Filed: Dec. 21, 2022

(65) Prior Publication Data

US 2023/0296273 A1 Sep. 21, 2023

Related U.S. Application Data

(63) Continuation of application No. PCT/KR2022/020296, filed on Dec. 14, 2022.

(30) Foreign Application Priority Data

Mar. 17, 2022 (KR) ..... 10-2022-0033444

(51) Int. Cl.
*F24F 11/42* (2018.01)
*F25B 13/00* (2006.01)
(Continued)

(52) U.S. Cl.
CPC ..... *F25B 47/022* (2013.01); *F24F 11/42* (2018.01); *F25B 13/00* (2013.01); *F25B 41/26* (2021.01);
(Continued)

(58) Field of Classification Search
CPC ..... F24F 11/42; F25B 6/02; F25B 2700/1931; F25B 2700/1933; F25B 47/022;
(Continued)

(56) References Cited

U.S. PATENT DOCUMENTS 6,012,294 A 1/2000 Utsumi
9,377,225 B2 7/2016 Song et al.
(Continued)

FOREIGN PATENT DOCUMENTS

CN 212179118 U 12/2020
EP 2 808 626 B1 7/2020
(Continued)

OTHER PUBLICATIONS

International Search Report dated Apr. 4, 2023 for International Application No. PCT/KR2022/020296.
(Continued)

*Primary Examiner* — Jerry-Daryl Fletcher
*Assistant Examiner* — Daniel C Comings
(74) *Attorney, Agent, or Firm* — STAAS & HALSEY LLP

(57) ABSTRACT

An air conditioner, and a control method, including a compressor to compress a refrigerant; an outdoor heat exchanger; a first four-way valve between a discharge port of the compressor and an upper inlet of the outdoor heat exchanger; a second four-way valve between the discharge port of the compressor and a lower inlet of the outdoor heat exchanger; and a controller electrically connected to the compressor and the first four-way valve and the second
(Continued)

four-way valve to control the first and second four-way valves to perform a first defrosting operation which defrosts an upper and a lower portion of the outdoor heat exchanger during a heating operation, and control the first and second four-way valves to perform a second defrosting operation which operates the upper portion as an evaporator, and operates the lower portion as a condenser, based on a detected need for additional defrosting of the lower portion.

16 Claims, 13 Drawing Sheets

(51) Int. Cl.

| | |
|---|---|
| ***F25B 41/26*** | (2021.01) |
| ***F25B 47/02*** | (2006.01) |
| *F24F 140/10* | (2018.01) |
| *F25B 5/02* | (2006.01) |
| *F25B 6/02* | (2006.01) |

(52) U.S. Cl.
CPC ..... *F25B 47/025* (2013.01); *F24F 2140/10* (2018.01); *F25B 5/02* (2013.01); *F25B 6/02* (2013.01); *F25B 2313/0251* (2013.01); *F25B 2313/02742* (2013.01); *F25B 2313/0315* (2013.01); *F25B 2347/021* (2013.01); *F25B 2600/23* (2013.01)

(58) Field of Classification Search
CPC ..... F25B 47/025; F25B 2313/025; F25B 2313/0251; F25B 2313/02742; F25B 2347/02; F25B 2347/021
See application file for complete search history.

(56) References Cited

U.S. PATENT DOCUMENTS

| | | | | |
|---|---|---|---|---|
| 10,473,353 | B2 | 11/2019 | Tani et al. | |
| 11,131,472 | B2 | 9/2021 | Lee et al. | |
| 2002/0129612 | A1* | 9/2002 | Saikusa | F25B 49/022 62/84 |
| 2013/0145785 | A1 | 6/2013 | Nobuhiro | |
| 2014/0165628 | A1 | 6/2014 | Tamura et al. | |
| 2017/0153050 | A1 | 6/2017 | Nakagawa et al. | |
| 2020/0124328 | A1* | 4/2020 | Tanaka | F25B 13/00 |
| 2020/0149754 | A1* | 5/2020 | K | F24F 3/153 |
| 2021/0080161 | A1* | 3/2021 | Tashiro | F25B 41/31 |
| 2021/0215403 | A1 | 7/2021 | Feng et al. | |
| 2022/0018581 | A1 | 1/2022 | Song et al. | |
| 2022/0049869 | A1 | 2/2022 | Sato et al. | |

FOREIGN PATENT DOCUMENTS

| | | | | |
|---|---|---|---|---|
| JP | 11-257718 | | 9/1999 | |
| JP | H11281213 | A * | 10/1999 | F25B 47/02 |
| JP | 3888403 | | 3/2007 | |
| JP | 2008-64381 | | 3/2008 | |
| JP | 4986443 | | 7/2012 | |
| JP | 2013-122354 | | 6/2013 | |
| JP | 2013-204952 | A | 10/2013 | |
| JP | 6285172 | | 2/2018 | |
| JP | 6486335 | | 3/2019 | |
| JP | 6950328 | | 10/2021 | |
| JP | 6964803 | | 11/2021 | |
| JP | 7275329 | | 5/2023 | |
| KR | 10-2009-0078023 | | 7/2009 | |
| KR | 10-2015-0060576 | A | 6/2015 | |
| KR | 10-1527214 | | 6/2015 | |
| KR | 10-1588205 | | 1/2016 | |
| KR | 101867858 | B1 * | 6/2018 | F25B 47/022 |
| KR | 10-2019-0068023 | A | 6/2019 | |
| KR | 10-2020-0064536 | | 6/2020 | |
| KR | 10-2021-0073991 | | 6/2021 | |
| KR | 10-2022-0011263 | A | 1/2022 | |
| KR | 10-2022-0045359 | | 4/2022 | |

OTHER PUBLICATIONS

Written Opinion dated Apr. 4, 2023 for International Application No. PCT/KR2022/020296.
Extended European Search Report dated Nov. 5, 2024 for European Application No. 22932414.0.

* cited by examiner

AIR CONDITIONER WITH DEFROSTING OPERATION AND METHOD FOR CONTROLLING THE SAME

CROSS-REFERENCE TO RELATED APPLICATION

This application is a continuation application, under 35 U.S.C. § 111(a), of International Patent Application No. PCT/KR2022/020296, filed on Dec. 14, 2022, which is based on and claims priority under 35 U. S. C. § 119 to Korean Patent Application No. 10-2022-0033444, filed on Mar. 17, 2022, in the Korean Intellectual Property Office, the disclosure of which is incorporated herein by reference in its entirety.

BACKGROUND

1. Field

The disclosure relates to an air conditioner and method for controlling the same.

2. Discussion of Related Art

Air conditioners are devices for conditioning air in indoor space by using transfer of heat produced from evaporation and condensation of a refrigerant to cool or heat the air and release the cooled or heated air. The air conditioner may circulate the refrigerant through a compressor, an indoor heat exchanger and an outdoor heat exchanger during a cooling operation or a heating operation, and cool or heat the indoor space by releasing the air that has exchanged heat in the indoor heat exchanger into the indoor space.

When the heating operation is performed under a cold and humid external environment, frost may form on the outdoor heat exchanger included in the outdoor unit. With the frosted heat exchanger, heating capacity deteriorates, leading to a decrease in product reliability. To remove the frost formed on the outdoor heat exchanger, the heating operation may be temporarily stopped and then a defrosting operation may be performed. Despite the defrosting operation, however, it may happen that the ice stuck on the outdoor heat exchanger is not completely removed.

SUMMARY

Aspects of embodiments of the disclosure will be set forth in part in the description which follows and, in part, will be apparent from the description, or may be learned by practice of the presented embodiments.

According to an embodiment of the disclosure, an air conditioner may include a compressor configured to compress a refrigerant, and including a discharge port; an outdoor heat exchanger configured to exchange heat with outside air, and including an upper portion including an upper inlet, and a lower portion including a lower inlet; a first four-way valve arranged between the discharge port of the compressor and the upper inlet; a second four-way valve arranged between the discharge port of the compressor and the lower inlet; and a controller electrically connected to the compressor, the first four-way valve and the second four-way valve. The controller may be configured to control the first four-way valve and the second four-way valve to perform a first defrosting operation which defrosts the upper portion and the lower portion during a heating operation, and control the first four-way valve and the second four-way valve to perform a second defrosting operation which operates the upper portion as an evaporator, and operates the lower portion as a condenser, based on a need for additional defrosting of the lower portion being detected.

According to an embodiment of the disclosure, the controller is configured to switch the first four-way valve and the second four-way valve so that refrigerant from the first four-way valve flows in through the upper inlet and refrigerant from the second four-way valve flow in through the lower inlet in response to starting the first defrosting operation, and switch the first four-way valve to discharge refrigerant from the upper inlet in response to starting the second defrosting operation.

According to an embodiment of the disclosure, the controller is configured to terminate the first defrosting operation based on a lapse of a preset reference defrosting time, and enter into the second defrosting operation based on a temperature of the lower portion detected at a time of termination of the first defrosting operation being lower than a preset threshold temperature.

According to an embodiment of the disclosure, the controller is configured to enter into the second defrosting operation based on a forced termination of the first defrosting operation occurring according to a preset compressor protection condition.

According to an embodiment of the disclosure, the controller is configured to forcedly terminate the first defrosting operation based on detection of inflow of a liquid refrigerant to the compressor, a current applied to the compressor exceeding a reference current, or temperature at the discharge port of the compressor exceeding a reference temperature.

According to an embodiment of the disclosure, the controller is configured to terminate the second defrosting operation based on a lapse of a preset additional defrosting time, and switch the second four-way valve to return to the heating operation.

According to an embodiment of the disclosure, the air conditioner further includes an accumulator; a first pressure sensor arranged between the compressor and the first four-way valve; and a second pressure sensor arranged between the first four-way valve and the accumulator. The controller may be configured to terminate the second defrosting operation based on a difference between a first pressure value of the first pressure sensor and a second pressure value of the second pressure sensor being equal to or greater than a preset threshold, and switch the second four-way valve to return to the heating operation.

According to an embodiment of the disclosure, the air conditioner further includes an accumulator. The second four-way valve may include a first port connected to the discharge port of the compressor; a second port connected to a suction port of the accumulator; a third port connected to the lower inlet; and a closed fourth port.

According to an embodiment of the disclosure, the lower portion includes a lower outlet through which a refrigerant brought in through the lower inlet is discharged, and a lower refrigerant tube connecting the lower inlet to the lower outlet, and the upper portion includes an upper outlet arranged above the lower outlet and through which a refrigerant brought in through the upper inlet is discharged, and an upper refrigerant tube connecting the upper inlet to the upper outlet.

According to an embodiment of the disclosure, the outdoor heat exchanger includes an upper inlet pipe connecting the upper inlet to the first four-way valve; a lower inlet pipe connecting the lower inlet to the second four-way valve; a lower outlet pipe connected to the lower outlet; and an upper outlet pipe connected to the upper outlet and the lower outlet pipe.

According to an embodiment of the disclosure, the outdoor heat exchanger includes a temperature sensor installed in the lower outlet pipe and configured to detect a temperature of the refrigerant discharged from the lower outlet.

According to an embodiment of the disclosure, a method of controlling an air conditioner including a first four-way valve arranged between a discharge port of a compressor and an upper inlet of an outdoor heat exchanger, and a second four-way valve arranged between the discharge port of the compressor and a lower inlet of the outdoor heat exchanger, includes controlling the first four-way valve and the second four-way valve to perform a first defrosting operation to defrost an upper portion of the outdoor heat exchanger and a lower portion of the outdoor heat exchanger during a heating operation; determining whether to perform a second defrosting operation to additionally defrost the lower portion of the outdoor heat exchanger based on termination of the first defrosting operation; and controlling the first four-way valve and the second four-way valve so that the upper portion of the outdoor heat exchanger operates as an evaporator, and the lower portion of the outdoor heat exchanger operates as a condenser, in the second defrosting operation.

According to an embodiment of the disclosure, the controlling of the first four-way valve and the second four-way valve includes switching the first four-way valve and the second four-way valve so that refrigerant from the first four-way valve flows in through the upper inlet of the outdoor heat exchanger and refrigerant from the second four-way valve flows in through the lower inlet of the outdoor heat exchanger in response to starting the first defrosting operation; and switching the first four-way valve to discharge refrigerant from the upper inlet of the outdoor heat exchanger in response to starting the second defrosting operation.

According to an embodiment of the disclosure, the determining of whether to perform the second defrosting operation includes terminating the first defrosting operation based on a lapse of a preset reference defrosting time; and entering into the second defrosting operation based on a temperature of a lower portion of the outdoor heat exchanger detected at a time of termination of the first defrosting operation being lower than a preset threshold temperature.

According to an embodiment of the disclosure, the determining of whether to perform the second defrosting operation includes entering into the second defrosting operation based on a forced termination of the first defrosting operation occurring according to a preset compressor protection condition.

According to an embodiment of the disclosure, an air conditioner may include a compressor configured to compress a refrigerant, and including a discharge port; an outdoor heat exchanger configured to exchange heat with outside air, and including an upper portion, an upper inlet, a lower portion, and a lower inlet; a first four-way valve arranged between the discharge port of the compressor and the upper inlet; a second four-way valve arranged between the discharge port of the compressor and the lower inlet; and a controller electrically connected to the compressor, the first four-way valve and the second four-way valve. The controller may be configured to control the first four-way valve so that refrigerant from the first four-way valve flows to the upper inlet, and control the second four-way valve so that refrigerant from the second four-way valve flows to the lower inlet, to defrost the upper and the lower portions during a heating operation, and control the first four-way valve to discharge refrigerant from the upper inlet, and control the second four-way valve so that the refrigerant from the second four-way valve flows to the lower inlet, to perform a second defrosting operation which defrosts the lower portion, based on a need for additional defrosting of the lower portion.

Additional embodiments of the disclosure will be set forth in part in the description which follows and, in part, will be obvious from the description, or will be apparent from the disclosure.

BRIEF DESCRIPTION OF THE DRAWINGS

These and/or other embodiments of the disclosure will become apparent and more readily appreciated from the following description of embodiments, taken in conjunction with the accompanying drawings of which.

DETAILED DESCRIPTION

Figure 1:
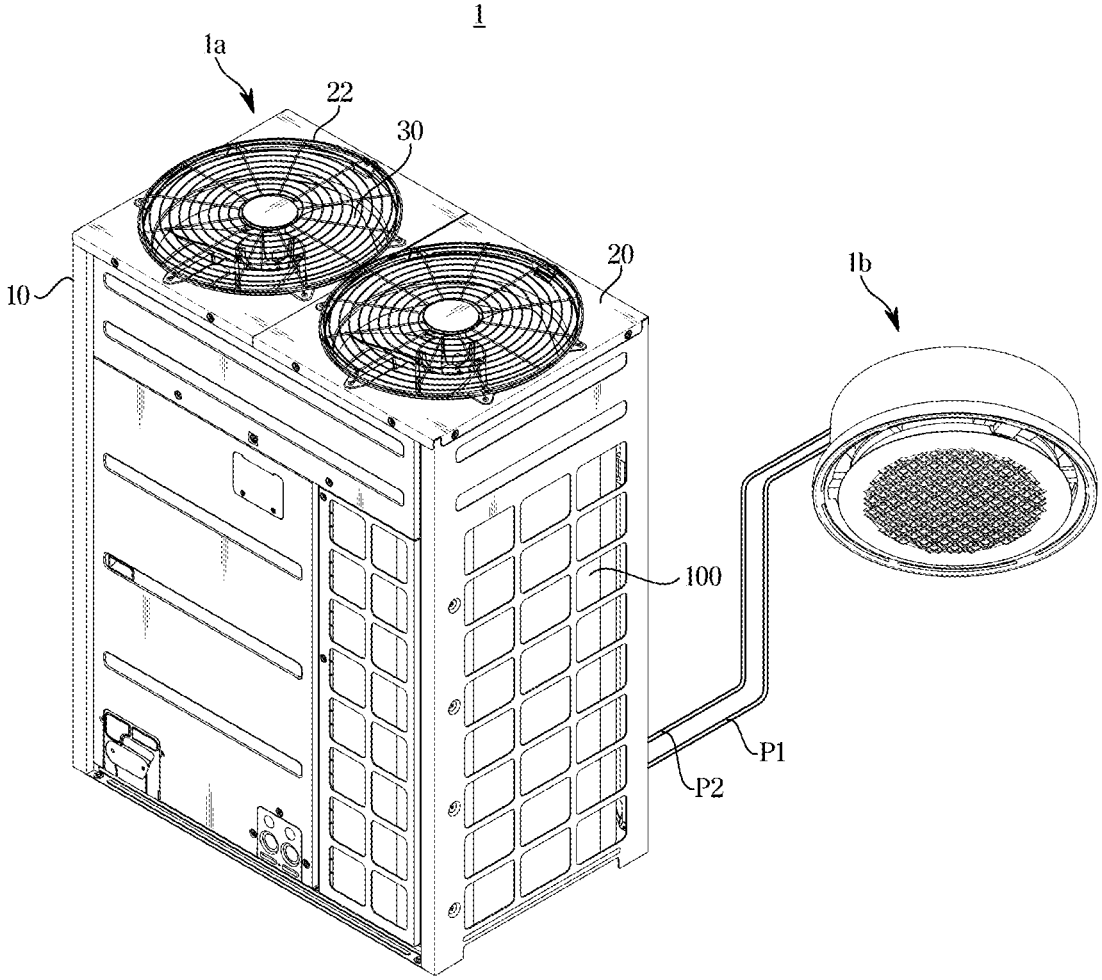
FIG. 1 illustrates an air conditioner, according to an embodiment of the disclosure.

Embodiments and features as described and illustrated in the disclosure are merely examples, and there may be various modifications replacing the embodiments and drawings at the time of filing this application.

It will be further understood that the term "connect" or its derivatives refer both to direct and indirect connection, and the indirect connection includes a connection over a wireless communication network.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure.

Furthermore, the terms, such as "~ part", "~ block", "~ member", "~ module", etc., may refer to a unit of handling at least one function or operation. For example, the terms may refer to at least one process handled by hardware such as field-programmable gate array (FPGA)/application specific integrated circuit (ASIC), etc., software stored in a memory, or at least one processor.

Reference numerals used for method steps are just used to identify the respective steps, but not to limit an order of the steps. Thus, unless the context clearly dictates otherwise, the written order may also be practiced otherwise.

The disclosure provides an air conditioner and method for controlling the same, which is capable of effectively removing frost on an outdoor heat exchanger by performing an additional defrosting operation to completely defrost the outdoor heat exchanger to the lower portion.

Reference will now be made in detail to embodiments of the disclosure, which are illustrated in the accompanying drawings.

FIG. 1 illustrates an air conditioner, according to an embodiment.

Referring to FIG. 1, an air conditioner 1 includes an outdoor unit 1*a* arranged in an outdoor space for performing heat exchange between outside air and a refrigerant, and an indoor unit 1*b* arranged in an indoor space for performing heat exchange between indoor air and a refrigerant. The outdoor unit 1*a* may be located outside an air conditioning space, and the indoor unit 1*b* may be located in the air conditioning space. The air conditioning space refers to a space that is cooled or heated by the air conditioner 1. For example, the outdoor unit 1*a* may be arranged outside a building, and the indoor unit 1*b* may be arranged in a space separated by a wall from the outside, such as a living room or an office room. The indoor unit 1*b* may be installed on the ceiling.

The outdoor unit 1*a* and the indoor unit 1*b* are connected through external pipes P1 and P2. A refrigerant may circulate through the outdoor unit 1*a*, the external pipes P1 and P2 and the indoor unit 1*b*. One end of the external pipe P1 or P2 may be connected to a piping valve arranged on one side of the outdoor unit 1*a*. Furthermore, the external pipe P1 or P2 may be connected to the outdoor unit 1*a* and a refrigerant pipe arranged inside the indoor unit 1*b*.

The outdoor unit 1*a* may include a cabinet 10 forming an exterior, a fan cover 20 for covering the top of the cabinet 10, and a fan assembly 30 arranged in the cabinet 10. The cabinet 10 may form four sides of the outdoor unit 1*a*. Two fan assemblies 30 are shown, without being limited thereto. The fan assembly 30 may be arranged in an upper portion in the cabinet 10. Furthermore, an outdoor heat exchanger 100 may be arranged in the cabinet 10.

A fan guard 22 may be arranged on the fan cover 20 to release air and protect the fan assembly 30. The fan cover 20 may include a discharge port corresponding to the shape of the fan assembly 30. The fan guard 22 may cover the discharge port of the fan cover 20 and may have the form of a grill or mesh. By operation of the fan assembly 30, outside air may pass the inside of the cabinet 10 of the outdoor unit 1*a* and may then be released out of the cabinet 10. The air flowing by the operation of the fan assembly 30 may be released out of the outdoor unit 1*a* through the fan guard 22.

Although it is described in FIG. 1 that the air conditioner 1 includes one outdoor unit 1*a* and one indoor unit 1*b*, the air conditioner 1 may include a plurality of outdoor units 1*a* and a plurality of indoor units 1*b*. For example, a plurality of indoor units 1*b* may be connected to one outdoor unit 1*a*. Furthermore, the form of the indoor unit 1*b* is not limited to what is described above. Any type of indoor unit 1*b* may be applied as long as the indoor unit 1*b* is installed in the indoor space and capable of cooling or heating the indoor space.

Figure 2:
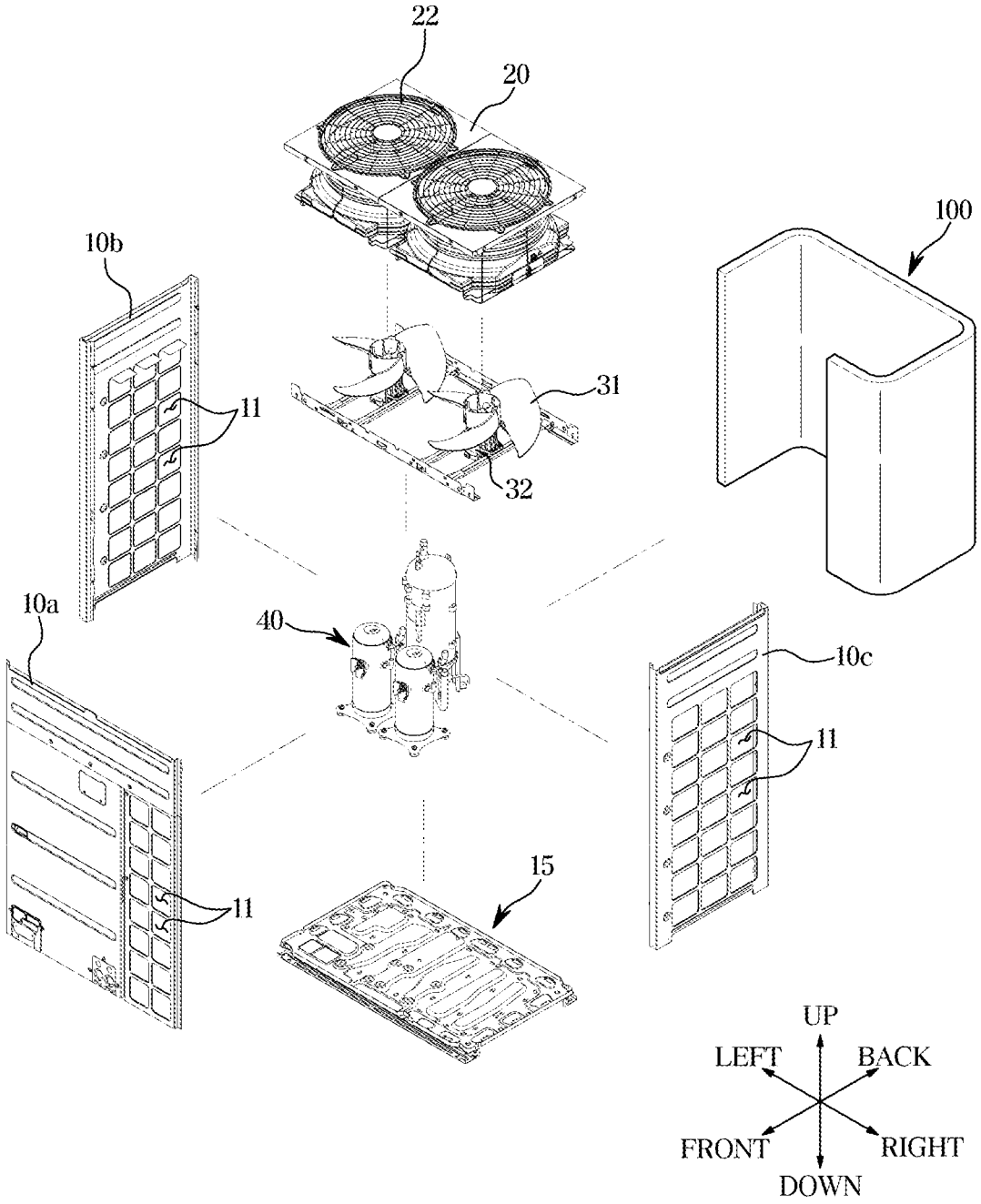
FIG. 2 is an exploded view of an outdoor unit of an air conditioner, according to an embodiment of the disclosure.

FIG. 2 is an exploded view of an outdoor unit of an air conditioner, according to an embodiment of the disclosure.

Referring to FIG. 2, the outdoor unit 1*a* of the air conditioner 1 may include the cabinet 10, a base 15, the fan cover 20, the fan guard 22, the fan assembly 30, a compressor 40 and the outdoor heat exchanger 100.

The cabinet 10 may include a front cabinet 10*a*, a left cabinet 10*b*, a right cabinet 10*c* and a rear cabinet (not shown). The front cabinet 10*a* and the rear cabinet may be provided in matching sizes. The left cabinet 10*b* and the right cabinet 10*c* may be provided in matching sizes.

The front cabinet 10*a*, the left cabinet 10*b* and the right cabinet 10*c* may each include a suction port 11 through which outside air is sucked into the outdoor unit 1*a* of the air conditioner 1. The outside air sucked into the outdoor unit 1*a* through the suction port 11 may exchange heat with the outdoor heat exchanger 100 and may then be released out of the outdoor unit 1*a* through the fan guard 22.

The base 15 may be arranged at the bottom of the cabinet 10 to support components of the outdoor unit 1*a* such as the compressor 40 and the outdoor heat exchanger 100. The base 15 may be coupled to bottom ends of the front cabinet 10*a*, the left cabinet 10*b*, the right cabinet 10*c* and the rear cabinet. The fan cover 20 may be coupled to top ends of the front cabinet 10*a*, the left cabinet 10*b*, the right cabinet 10*c* and the rear cabinet.

The fan assembly 30 may include a blade 31 and a motor 32. The blade 31 may be rotated by operation of the motor 32, and air may flow by the rotation of the blade 31.

The outdoor heat exchanger 100 may be arranged along inner edges of the cabinet 10. For example, the outdoor heat exchanger 100 may be provided to cover the four surfaces of the cabinet 10. The outdoor heat exchanger 100 may be provided in a form of having bending portions adjoining corners of the cabinet 10.

Figure 3:
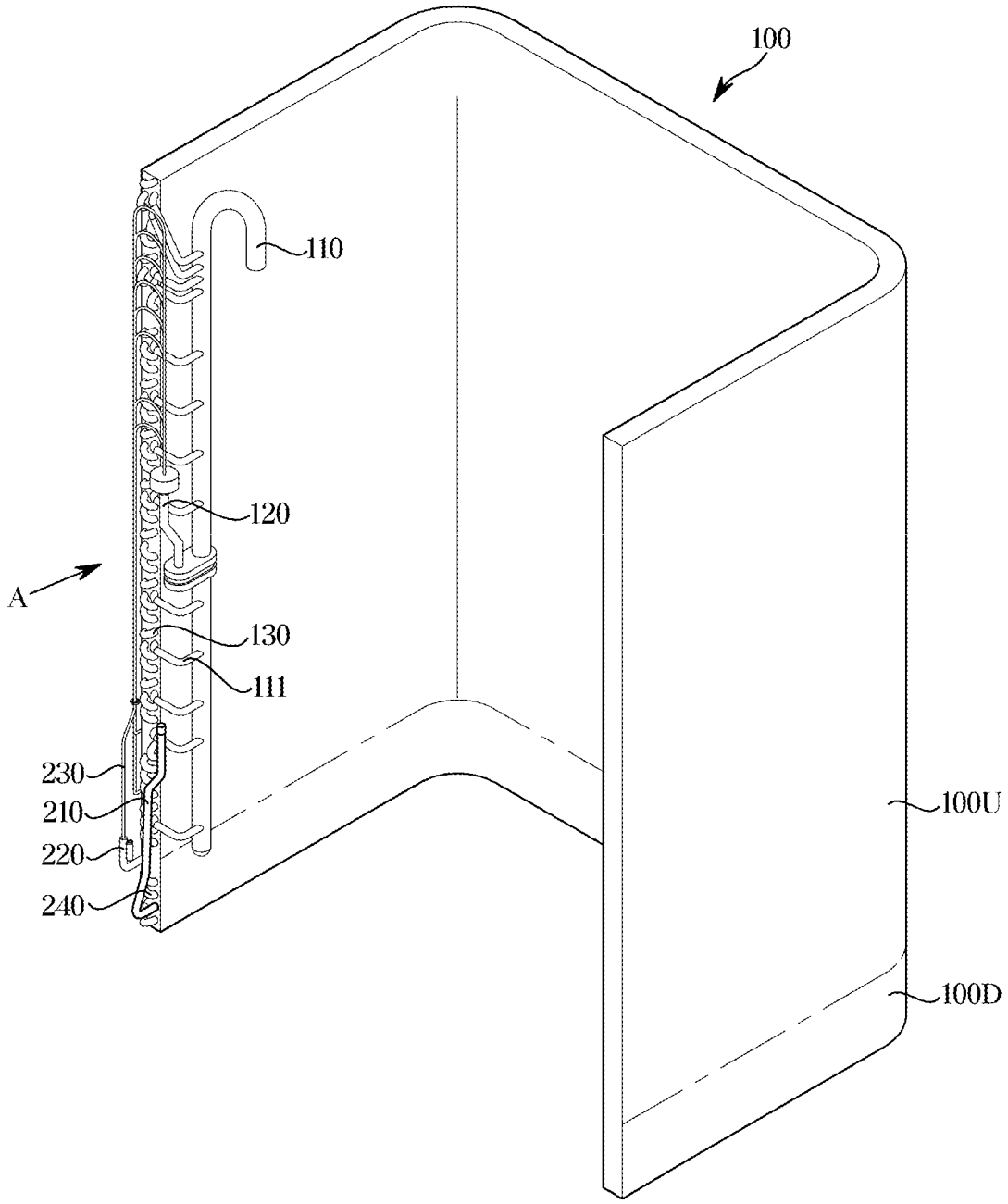
FIG. 3 is a perspective view of an outdoor heat exchanger, according to an embodiment of the disclosure.
Figure 4:
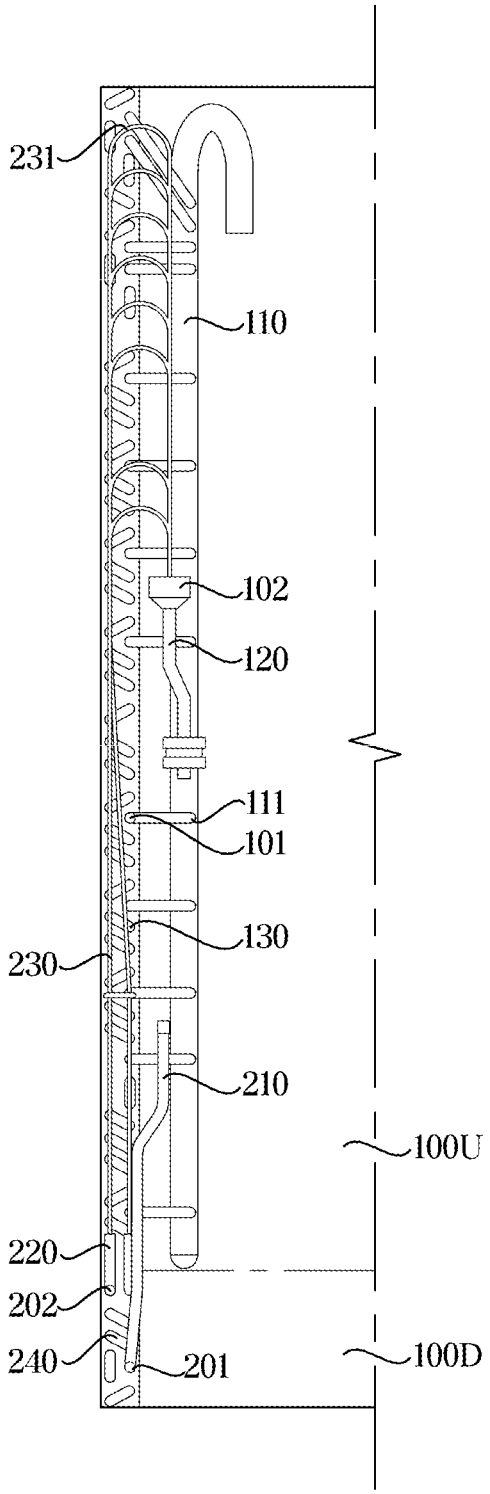
FIG. 4 is a plan view of an outdoor heat exchanger viewed from direction A, according to an embodiment of the disclosure.
Figure 5:
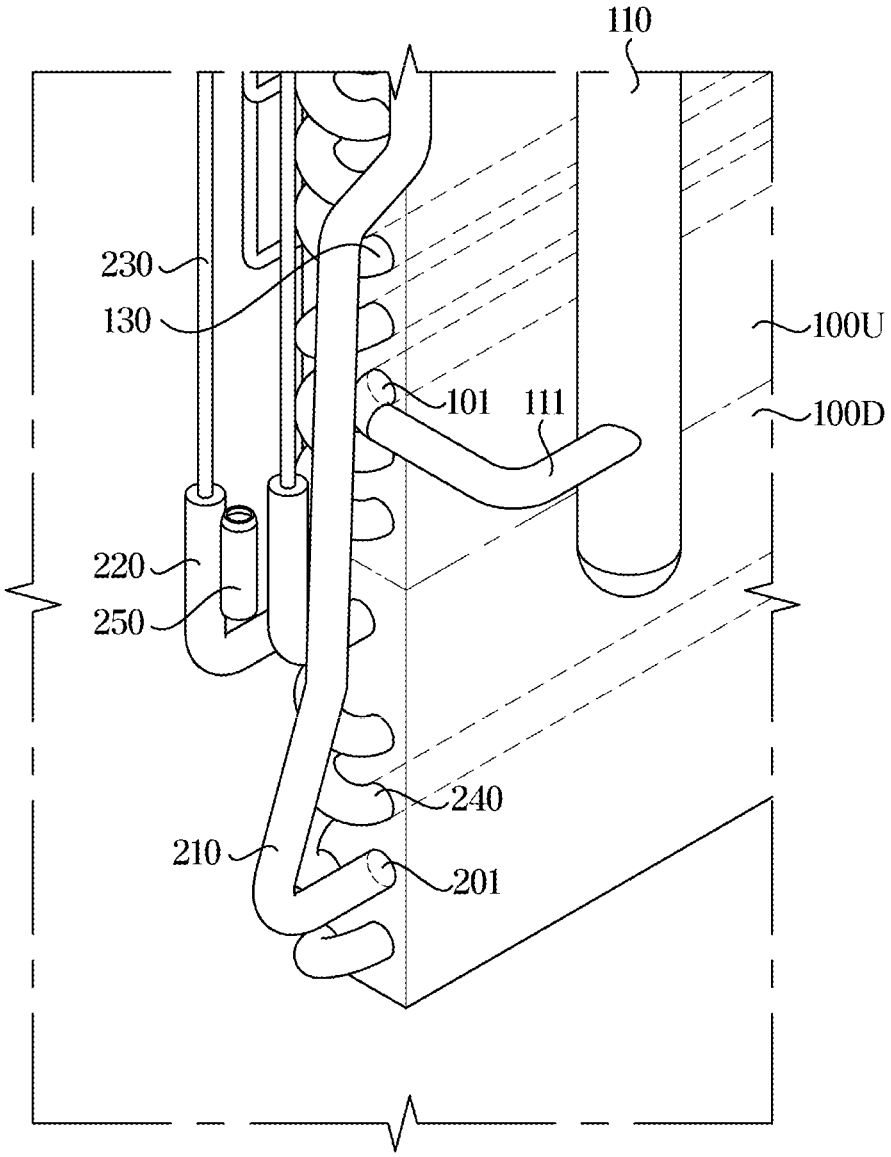
FIG. 5 is an enlarged view of a lower portion of a heat exchanger, according to an embodiment of the disclosure.

FIG. 3 is a perspective view of an outdoor heat exchanger, according to an embodiment of the disclosure. FIG. 4 is a plan view of an outdoor heat exchanger viewed from direction A, according to an embodiment of the disclosure. FIG. 5 is an enlarged view of a lower portion of a heat exchanger, according to an embodiment of the disclosure.

Referring to FIGS. 3, 4 and 5, the outdoor heat exchanger 100 may include an upper inlet 101, an upper outlet 102, an upper inlet pipe 110, a connection tube 111, an upper outlet pipe 120, an upper refrigerant tube 130, a lower inlet 201, a lower outlet 202, a lower inlet pipe 210, a lower outlet pipe 220, a capillary tube 230, and a lower refrigerant tube 240.

The upper inlet 101 may be referred to as a first inlet, the upper outlet 102 as a first outlet, the lower inlet 201 as a second inlet and the lower outlet 202 as a second outlet. The upper inlet pipe 110 may be referred to as a first inlet pipe, the upper outlet pipe 120 as a first outlet pipe, the lower inlet pipe 210 as a second inlet pipe and the lower outlet pipe 220 as a second outlet pipe.

The outdoor heat exchanger 100 may be divided into an upper portion 100U and a lower portion 100D. For example, the lower portion 100D of the outdoor heat exchanger 100 may include the lower outlet 202, and may be defined to be a portion under the lower outlet 202. The lower portion 100D of the outdoor heat exchanger 100 may be defined to include a portion from the bottom of the outdoor heat exchanger 100 to a position of the lower outlet 202 of the outdoor heat exchanger 100. The lower portion 100D of the outdoor heat exchanger 100 may include the lower inlet 201, the lower outlet 202 and the lower refrigerant tube 240. The upper portion 100U of the outdoor heat exchanger 100 may include a portion above the lower outlet 202. The upper portion 100U of the outdoor heat exchanger 100 may include the upper inlet 101 located above the lower outlet 202, the upper outlet 102 and the upper refrigerant tube 130.

When the air conditioner 1 performs a cooling operation or a defrosting operation, the refrigerant discharged from the compressor 40 may pass a first four-way valve 50 (shown in FIG. 7), flow into the upper inlet pipe 110, and be distributed into the plurality of connection tubes 111. The refrigerant flowing into the plurality of connection tubes 111 may flow into the plurality of upper inlets 101. The refrigerant flowing into the plurality of upper inlets 101 may flow along the upper refrigerant tube 130.

The upper inlet 101 of the outdoor heat exchanger 100 may be provided in the plural. The plurality of upper inlets 101 may be connected to the upper inlet pipe 110 by the plurality of connection tubes 111. The upper inlet pipe 110 may be connected to the first four-way valve 50. The upper inlet 101 of the outdoor heat exchanger 100 may be connected to the first four-way valve 50 through the upper inlet pipe 110. As there are a plurality of upper inlets 101, the upper refrigerant tube 130 may also be provided in the plural.

The refrigerant flowing in through the upper inlet 101 of the outdoor heat exchanger 100 may flow along the upper refrigerant tube 130 and may then be discharged through the upper outlet 102 of the outdoor heat exchanger 100. The upper outlet 102 may be connected to the upper outlet pipe 120, and the refrigerant may be discharged out of the outdoor heat exchanger 100 through the upper outlet pipe 120. The upper outlet pipe 120 may be connected to the first external pipe P1 connecting the outdoor unit 1*a* to the indoor unit 1*b*, and the refrigerant may be supplied to the indoor unit 1*b* through the first external pipe P1.

The refrigerant flowing along the plurality of upper refrigerant tubes 130 may be collected at the upper outlet 102 through the plurality of capillary tubes 230. Specifically, each of the plurality of upper refrigerant tubes 130 may be connected to an end of each of the plurality of capillary tubes 230, and the other ends of the plurality of capillary tubes 230 may join together and be connected to the upper outlet pipe 120. Each of the plurality of capillary tubes 230 may include a U-shaped bending part 231.

The lower inlet 201 of the outdoor heat exchanger 100 may be connected to the lower inlet pipe 210. The lower inlet pipe 210 may be connected to a second four-way valve 60 (shown in FIG. 6). The lower inlet 201 of the outdoor heat exchanger 100 may be connected to the second four-way valve 60 through the lower inlet pipe 210. When the air conditioner 1 performs a cooling operation or a defrosting operation, the refrigerant discharged from the compressor 40 may flow in through the lower inlet 201 through the second four-way valve 60 and the lower inlet pipe 210. The refrigerant flowing in through the lower inlet 201 may flow along the lower refrigerant tube 240 located in the lower portion of the outdoor heat exchanger 100.

The refrigerant flowing in through the lower inlet 201 of the outdoor heat exchanger 100 may flow along the lower refrigerant tube 240 and may then be discharged through the lower outlet 202 of the outdoor heat exchanger 100. The lower outlet 202 may be connected to the lower outlet pipe 220, which may then be connected to the upper outlet pipe 120. The lower outlet pipe 220 may be connected to one end of the capillary tube 230, and the other end of the capillary tube 230 may be connected to the upper outlet pipe 120. The refrigerant may flow into the upper outlet pipe 120 through the lower outlet pipe 220.

The refrigerant may be condensed or evaporated while flowing along a flow path formed by the refrigerant tube 130 or 240. The refrigerant may emit heat by being condensed. The refrigerant may be evaporated by absorbing heat from surrounding air. To facilitate condensation or evaporation of the refrigerant, a fin assembly may be coupled onto the outer surface of the refrigerant tube 130 or 240.

The fin assembly may include a plurality of heat exchange fins. The heat exchange fins may be arranged orthogonally from a direction of the length of the refrigerant tubes 130 and 240. The heat exchange fins may be separately arranged at preset intervals. The fin assembly may form the outer surface of the outdoor heat exchanger 100 and may serve to widen a heat exchange area of the refrigerant tube 130 or 240.

The upper refrigerant tube 130 and the lower refrigerant tube 240 may extend along the inner edges of the cabinet 10 of the outdoor unit 1*a*. The refrigerant tubes 130 and 240 may extend in the front-back direction and the left-right direction of the outdoor unit 1*a*. The refrigerant tubes 130 and 240 may be provided in a form of having bending portions adjoining corners of the cabinet 10. The refrigerant tube 130 or 240 may be twisted and turned by bending in the U-shape on one side.

A temperature sensor 250 may be installed in the lower outlet pipe 220. The temperature sensor 250 may detect a temperature of the refrigerant discharged from the lower outlet 202 of the outdoor heat exchanger 100. The temperature sensor 250 installed in the lower outlet pipe 220 may be referred to as a second temperature sensor.

Unlike what is described above, when the air conditioner 1 performs a heating operation, the direction of a flow of the refrigerant in the outdoor heat exchanger 100 may be the opposite of the direction of a flow of the refrigerant in the cooling operation or the defrosting operation. When the air conditioner 1 performs the heating operation, the refrigerant may flow into the outdoor heat exchanger 100 through the upper outlet pipe 120, and may be discharged out of the outdoor heat exchanger 100 through the upper inlets 101 and the lower inlets 201 of the outdoor heat exchanger 100. For convenience of explanation, the inlet and the outlet of the outdoor heat exchanger 100 may be defined based on the cooling operation.

Furthermore, in a sub-defrosting operation to additionally defrost the lower portion of the outdoor heat exchanger 100, a direction of a flow of the refrigerant in the upper portion of the outdoor heat exchanger 100 may be opposite the direction of a flow of the refrigerant in the lower portion of the outdoor heat exchanger 100. In the sub-defrosting operation, the lower portion of the outdoor heat exchanger 100 may operate as a condenser, and the upper portion of the outdoor heat exchanger 100 may operate as an evaporator. In other words, while the refrigerant flows in through the lower inlet 201 of the outdoor heat exchanger 100, the refrigerant may be discharged from the upper inlet 101 of the outdoor heat exchanger 100.

Figure 6:
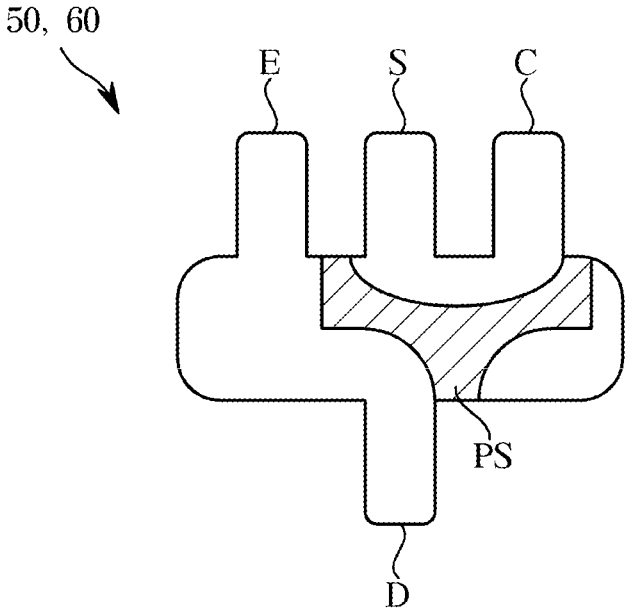
FIG. 6 illustrates a four-way valve, according to an embodiment of the disclosure.

FIG. 6 illustrates a four-way valve, according to an embodiment of the disclosure.

Referring to FIG. 6, the first four-way valve 50 and the second four-way valve 60 may each include four ports. Specifically, the first four-way valve 50 and the second four-way valve 60 may each include a D port, an S port, a C port and an E port. The D port, the S port, the C port and the E port may be referred to as a first port, a second port, a third port and a fourth port, respectively.

As for the first four-way valve 50, the D port is connected to a discharge line P3 extending from a discharge port of the compressor 40, the S port is connected to a suction line P4 extending from a suction port of the accumulator 80, the C port is connected to the upper inlet pipe 110 of the outdoor heat exchanger 100, and the E port is connected to the refrigerant pipe that leads to the second external pipe P2.

As for the second four-way valve 60, the D port is connected to the discharge line P3 extending from the discharge port of the compressor 40, the S port is connected to a suction line P4 extending from the suction port of the accumulator 80, and the C port is connected to the lower inlet pipe 210 of the outdoor heat exchanger 100 However, the E port of the second four-way valve 60 is closed.

Furthermore, the first four-way valve 50 and the second four-way valve 60 each include a piston assembly PS arranged inside. The piston assembly PS is movable, and depending on the position of the piston assembly PS, a direction of a flow of the refrigerant discharged from the compressor 40 is determined.

Operations of the first four-way valve 50 and the second four-way valve 60 in the cooling operation, the main defrosting operation, the heating operation and the sub-defrosting operation of the air conditioner 1 will now be described. The main defrosting operation may also be referred to as a first defrosting operation. The sub-defrosting operation may also be referred to as a second defrosting operation or an additional defrosting operation.

Figure 7:
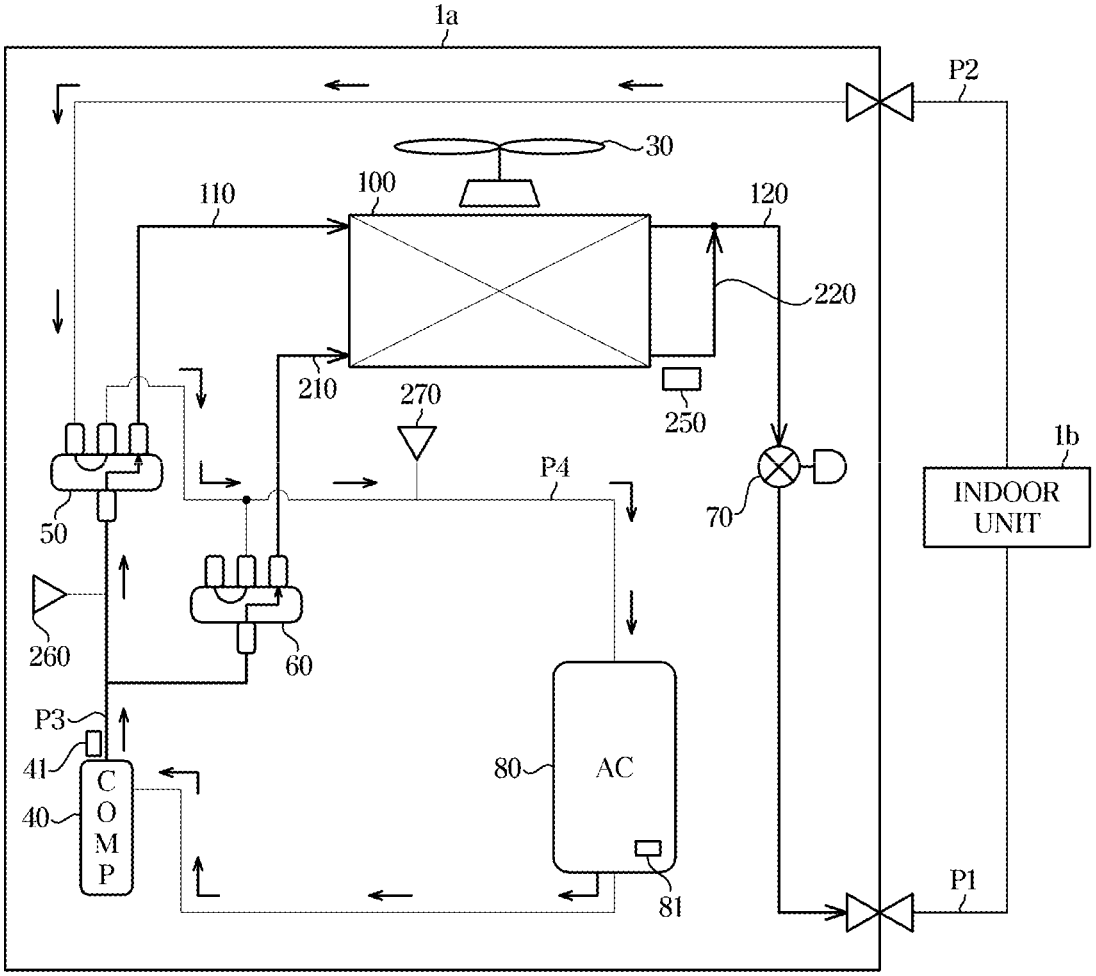
FIG. 7 illustrates flows of a refrigerant in a cooling operation or a main defrosting operation according to an embodiment of the disclosure.
Figure 8:
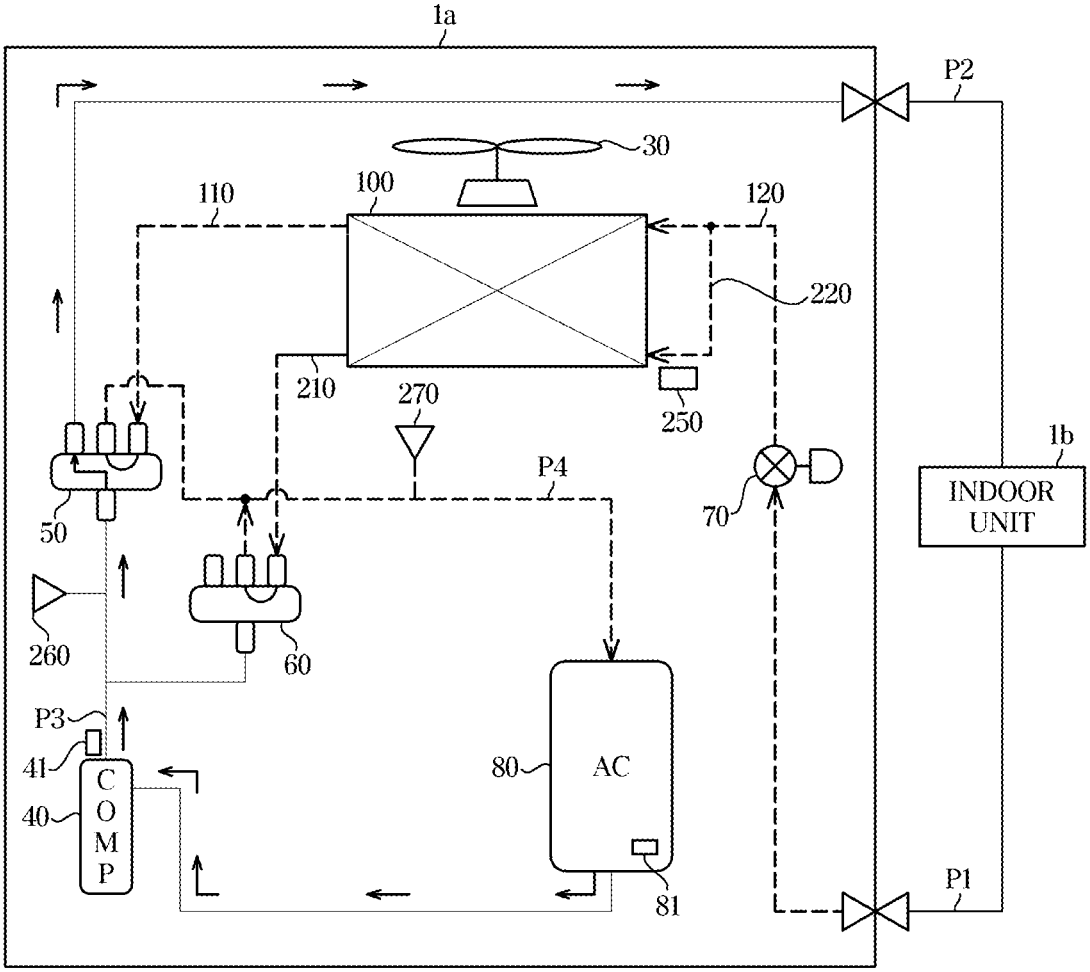
FIG. 8 illustrates flows of a refrigerant in a heating operation according to an embodiment of the disclosure.
Figure 9:
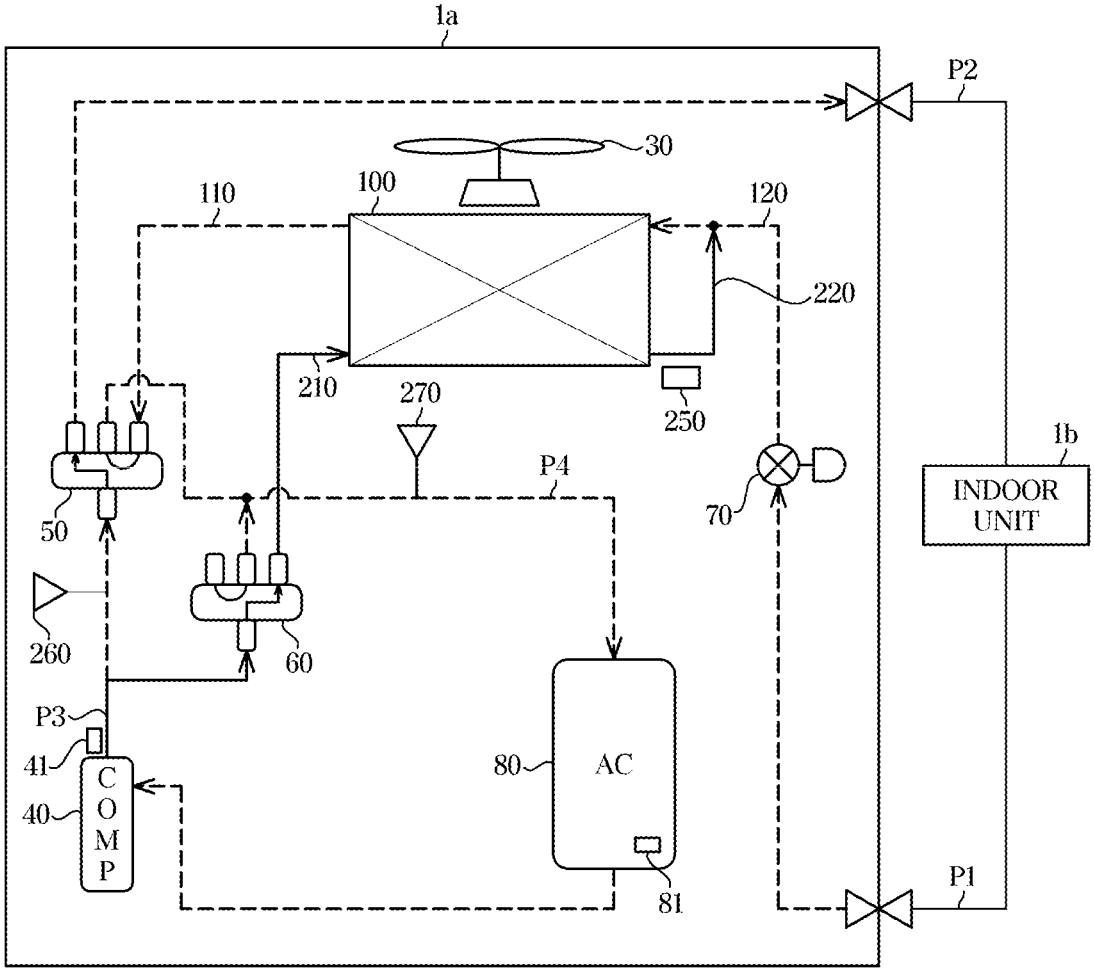
FIG. 9 illustrates flows of a refrigerant in a sub-defrosting operation according to an embodiment of the disclosure.

FIG. 7 illustrates flows of a refrigerant in a cooling operation or a main defrosting operation. FIG. 8 illustrates flows of a refrigerant in a heating operation. FIG. 9 illustrates flows of a refrigerant in a sub-defrosting operation.

Referring to FIGS. 7, 8 and 9, the outdoor unit 1*a* of the air conditioner 1 includes the fan assembly 30 for moving air, the compressor 40 for compressing the refrigerant, the outdoor heat exchanger 100 for performing heat exchange between the outside air and the refrigerant, the first four-way valve 50 arranged between the discharge port of the compressor 40 and the upper inlet 101 of the outdoor heat exchanger 100, the second four-way valve 60 arranged between the discharge port of the compressor 40 and the lower inlet 201 of the outdoor heat exchanger 100, an expansion valve 70 for decompressing the refrigerant, and the accumulator 80 for preventing a liquid refrigerant that has not been evaporated from flowing into the compressor 40.

The fan assembly 30 may be arranged around the outdoor heat exchanger 100 to move the outside air to the outdoor heat exchanger 100. The fan assembly 30 may suck in air outside the outdoor unit 1*a* and simultaneously, move the air that has exchanged heat in the outdoor heat exchanger 100 to the outside of the outdoor unit 1*a*.

The compressor 40 may operate with electric energy provided from an external power source. The compressor 40 includes a compressor motor (not shown) and compresses a gaseous refrigerant of low pressure into high pressure by using the rotational force of the compressor motor. An operation frequency of the compressor 40 may be changed to correspond to a capacity required by the indoor unit 1*b*. The compressor 40 may be an inverter air compressor, a positive displacement compressor or a dynamic compressor, and various types of compressors that may be considered by a designer may be used.

The first four-way valve 50 may change a moving direction of the high temperature and high pressure gaseous refrigerant discharged from the compressor 40. In the cooling operation or main defrosting operation, the first four-way valve 50 is controlled to lead the refrigerant compressed by the compressor 40 to the upper portion of the outdoor heat exchanger 100. In the heating operation or sub-defrosting operation, the first four-way valve 50 is controlled to lead the refrigerant compressed by the compressor 40 to the indoor unit 1*b* and the refrigerant discharged from the outdoor heat exchanger 100 to the accumulator 80.

In the cooling operation, main defrosting operation or sub-defrosting operation, the second four-way valve 60 is controlled to lead the refrigerant compressed by the compressor 40 to the lower portion of the outdoor heat exchanger 100. In the heating operation, the second four-way valve 60 is controlled to lead the refrigerant discharged from the lower portion of the outdoor heat exchanger 100 to the accumulator 80. As the E port (the fourth port) of the second four-way valve 60 is closed, the high temperature and high pressure refrigerant discharged from the compressor 40 in the heating operation may not pass the second four-way valve 60.

The expansion valve 70 may expand the refrigerant in a high temperature and high pressure liquid state and discharge a mixture of gaseous and liquid refrigerants of low temperature and low pressure. The expansion valve 70 may control an amount of refrigerant provided to the indoor heat exchanger of the indoor unit 1*b*. The expansion valve 70 decompresses the refrigerant by using throttling actions. The throttling actions refer to a reduction in pressure of the refrigerant when the refrigerant passes a narrow flow path even without heat exchange with the outside.

The expansion valve 70 may be an electronic expansion valve (EEV) capable of controlling an opening degree. The expansion valve 70 may be a thermoelectric electronic expansion valve that uses deformation of a bimetal, a thermostatic electronic expansion valve that uses volumetric expansion by heating enclosed wax, a pulse width modulation type electronic expansion valve for opening or closing a solenoid valve according to a pulse signal, or a step motor type electronic expansion valve that uses a motor to open or close the valve.

Furthermore, the outdoor unit 1*a* may include a first temperature sensor 41 for detecting a temperature at the discharge port of the compressor 40 and a second temperature sensor 250 for detecting a temperature of the refrigerant discharged from the lower outlet 201 of the outdoor heat exchanger 100. The first temperature sensor 41 may be installed at the discharge port of the compressor 40. The second temperature sensor 250 may be installed in the lower outlet pipe 220 connected to the lower outlet 201 of the outdoor heat exchanger 100. The first temperature sensor 41 and the second temperature sensor 250 may be implemented with a bimetal thermometer, a thermistor thermometer, or an infrared thermometer.

Apart from this, the air conditioner 1 may include various temperature sensors. For example, a temperature sensor (not shown) may be provided on the side of the inlet of the outdoor heat exchanger 100. The temperature sensor for detecting the temperature of the outdoor heat exchanger 100 may be installed around the inlet and/or the outlet of the outdoor heat exchanger 100 or installed to be in contact with a refrigerant pipe connected to the inlet and/or the outlet of the outdoor heat exchanger 100. Furthermore, an outdoor temperature sensor may also be provided to detect outdoor temperature.

The accumulator 80 may include a level sensor 81. The level sensor 81 may detect a level of the liquid refrigerant stored in the accumulator 80. When the level of the liquid refrigerant accumulated in the accumulator 80 becomes higher than a preset reference level, the liquid refrigerant may flow into the compressor 40. When the liquid refrigerant flows into the compressor 40, the compressor 40 may be broken. When the level of the liquid refrigerant detected by the level sensor 81 becomes higher than the reference level, the outdoor unit 1*a* may terminate operation of the compressor 40 and operate the accumulator 80 to evaporate the liquid refrigerant.

Furthermore, the outdoor unit 1*a* may include a first pressure sensor 260 arranged between the compressor 40 and the first four-way valve 50, and a second pressure sensor 270 arranged between the first four-way valve 50 and the accumulator 80. The first pressure sensor 260 may be installed in the discharge line P3 connected to the discharge port of the compressor 40. The first pressure sensor 260 may detect pressure of the refrigerant flowing in the discharge line P3. The second pressure sensor 270 may be installed in the suction line P4 connected to the suction port of the accumulator 80. The second pressure sensor 270 may detect pressure of the refrigerant flowing in the suction line P4. The discharge line P3 and the suction line P4 may be provided as pipes.

The air conditioner 1 includes a refrigerant flow path in which to circulate the refrigerant between the indoor unit 1*b* and the outdoor unit 1*a*. The refrigerant may be circulated to the indoor unit 1*b* and the outdoor unit 1*a* along the refrigerant flow path, and absorb or emit heat through a change in state (e.g., a change in state from gas to liquid or liquid to gas). The air conditioner 1 may include the first external pipe P1 serving as a passage in which the liquid refrigerant flows and the second external pipe P2 serving as a passage in which the gaseous refrigerant flows, the first and second external pipes P1 and P2 connecting between the outdoor unit 1*a* and the indoor unit 1*b*. The first external pipe P1 and the second external pipe P2 may be connected to the refrigerant pipes in the outdoor unit 1*a* and the indoor unit 1*b*. The first external pipe P1 may be referred to as a liquid pipe, and the second external pipe P2 may be referred to as a gas pipe.

The outdoor heat exchanger 100 serves as a condenser for condensing the refrigerant compressed by the compressor 40 in the cooling operation or the main defrosting operation, and serves as an evaporator for evaporating the refrigerant decompressed in the indoor unit 1*b* in the heating operation. In the sub-defrosting operation, the upper portion 100U of the outdoor heat exchanger 100 may operate as an evaporator, and the lower portion 100D of the outdoor heat exchanger 100 may operate as a condenser. Accordingly, heat is emitted from the lower portion 100D of the outdoor heat exchanger 100, enabling defrosting.

Referring to FIG. 7, when the air conditioner 1 performs the cooling operation, the refrigerant may emit heat in the outdoor heat exchanger 100 of the outdoor unit 1*a* and absorb heat in the indoor heat exchanger of the indoor unit 1*b*. In the cooling operation, the refrigerant compressed by the compressor 40 is supplied to the first four-way valve 50 and the second four-way valve 60 through the discharge line P3.

The first four-way valve 50 and the second four-way valve 60 are controlled to supply the refrigerant flowing in from the discharge line P3 to the outdoor heat exchanger 100. Accordingly, the refrigerant is supplied to the upper portion of the outdoor heat exchanger 100 along the upper inlet pipe 110 connected to the first four-way valve 50. Furthermore, the refrigerant is supplied to the lower portion of the outdoor heat exchanger 100 along the lower inlet pipe 210 connected to the second four-way valve 60.

The refrigerant flowing in through the upper inlet 101 of the outdoor heat exchanger 100 may be discharged through the upper outlet 102 of the outdoor heat exchanger 100. The upper outlet 102 may be connected to the upper outlet pipe 120, and the refrigerant may be discharged out of the outdoor heat exchanger 100 through the upper outlet pipe 120. The refrigerant flowing in through the lower inlet 102 of the outdoor heat exchanger 100 may flow into the upper outlet pipe 120 through the lower outlet pipe 220 connected to the lower portion of the outdoor heat exchanger 100. The lower outlet pipe 220 is connected to the upper outlet pipe 120.

The refrigerant discharged from the outdoor heat exchanger 100 is supplied into the indoor unit 1*b* through the expansion valve 70. In the cooling operation, the outdoor heat exchanger 100 operates as a condenser that emits heat while condensing the refrigerant, and the indoor heat exchanger of the indoor unit 1*b* operates as an evaporator that evaporates the refrigerant by absorbing heat.

As such, in the cooling operation, the high temperature and high pressure gaseous refrigerant discharged from the compressor 40 is moved to the outdoor heat exchanger 100. The refrigerant condensed in the outdoor heat exchanger 100, which is almost in a liquid state, is decompressed by being expanded by the expansion valve 70. The two-phase refrigerant that has passed the expansion valve 70 is moved to the indoor heat exchanger of the indoor unit 1*b*. The refrigerant flowing into the indoor heat exchanger of the indoor unit 1*b* is evaporated by exchanging heat with surrounding air. Hence, the temperature of the surrounding air that has exchanged heat falls, and cold air is discharged out of the indoor unit 1*b*.

In the main defrosting operation of the air conditioner 1, a direction of a flow of the refrigerant may correspond to a direction of a flow of the refrigerant in the cooling operation. The outdoor heat exchanger 100 needs to emit heat to remove frost formed on the outdoor heat exchanger 100, so the outdoor heat exchanger 100 operates as a condenser even in the main defrosting operation. The main defrosting operation may also be referred to as the first defrosting operation.

Referring to FIG. 8, in the heating operation, the refrigerant may emit heat in the indoor heat exchanger of the indoor unit 1*b* and absorb heat in the outdoor heat exchanger 100. In the heating operation, the first four-way valve 50 may be controlled to supply the refrigerant compressed by the compressor 40 first to the indoor heat exchanger of the indoor unit 1*b*.

In the heating operation, the high temperature and high pressure gaseous refrigerant discharged from the compressor 40 flows in through the D port of the first four-way valve 50 and is led to the second external pipe P2 through the E port of the first four-way valve 50. However, the second four-way valve 60 may be controlled to prevent the refrigerant discharged from the compressor 40 from flowing into the second four-way valve 60. Accordingly, the refrigerant discharged from the compressor 40 may be moved to the indoor heat exchanger of the indoor unit 1*b*.

The refrigerant that has passed the indoor unit 1*b* may pass the expansion valve 70 of the outdoor unit 1*a* and then flow into the outdoor heat exchanger 100. The outdoor heat exchanger 100 operates as an evaporator for evaporating the refrigerant. The refrigerant that has passed the expansion valve 70 may flow in through the upper outlet 102 of the outdoor heat exchanger 100 through the upper outlet pipe 120 of the outdoor heat exchanger 100, and flow in through the lower outlet 202 of the outdoor heat exchanger 100 through the lower outlet pipe 220 connected to the upper outlet pipe 120.

In the heating operation, the refrigerant flowing in through the upper outlet 102 of the outdoor heat exchanger 100 is moved to the first four-way valve 50 through the upper inlet 101. The refrigerant that has passed the first four-way valve 50 may go into the accumulator 80 along the suction line P4. The refrigerant flowing in through the lower outlet 202 of the outdoor heat exchanger 100 is moved to the second four-way valve 60 through the lower inlet 201. The refrigerant that has passed the second four-way valve 60 may also go into the accumulator 80 along the suction line P4. The accumulator 80 separates the gaseous refrigerant from the liquid refrigerant and supplies the gaseous refrigerant back into the compressor 40.

As such, the high temperature and high pressure gaseous refrigerant supplied from the outdoor unit 1*a* to the indoor unit 1*b* exchanges heat with cold and dry air in the indoor unit 1*b*. The indoor heat exchanger of the indoor unit 1*b* operates as a condenser that condenses the refrigerant. The refrigerant emits heat while being condensed into the liquid or almost liquid refrigerant, and air absorbs the heat so that warm air is released out of the indoor unit 1*b*.

Referring to FIG. 9, the air conditioner 1 may perform the sub-defrosting operation to additionally defrost the lower portion of the outdoor heat exchanger 100. The sub-defrosting operation may be referred to as the second defrosting operation.

In the main defrosting operation as described above in connection with FIG. 7, an amount of the refrigerant flowing in the lower portion 100D of the outdoor heat exchanger 100 may be smaller than an amount of the refrigerant flowing in the upper portion 100U of the outdoor heat exchanger 100. Furthermore, the heat emitted from the upper portion 100U of the outdoor heat exchanger 100 may not be transferred to the lower portion 100D. In addition, according to structural properties of the outdoor heat exchanger 100, a top ice layer is melted first, and because water flows down to the lower portion by the gravity, ice on the bottom of the outdoor heat exchanger 100 is melted last. That is, sometimes, the outdoor heat exchanger 100 may not be completely defrosted depending on an outside environment (temperature and humidity) and/or an operation of the indoor unit 1*b*. In other words, even when the main defrosting operation is performed to defrost the whole outdoor heat exchanger 100, it may happen that the lower portion 100D of the outdoor heat exchanger 100 is not completely defrosted. To solve this problem, the air conditioner 1 in the disclosure may improve defrosting performance by additionally defrosting the lower portion 100D of the outdoor heat exchanger 100.

When the air conditioner 1 performs the sub-defrosting operation, the lower portion 100D of the outdoor heat exchanger 100 may operate as a condenser and the upper portion 100U of the outdoor heat exchanger 100 may operate as an evaporator. While the refrigerant flows in through the lower inlet 201 of the outdoor heat exchanger 100, the refrigerant may be discharged from the upper inlet 101 of the outdoor heat exchanger 100.

In the sub-defrosting operation, the first four-way valve 50 is controlled to lead the refrigerant compressed by the compressor 40 to the indoor unit 1*b* and the refrigerant discharged from the outdoor heat exchanger 100 to the accumulator 80. The second four-way valve 60 is controlled to lead the refrigerant compressed by the compressor 40 to the lower portion of the outdoor heat exchanger 100.

In the sub-defrosting operation, the high temperature and high pressure gaseous refrigerant discharged from the compressor 40 flows in through the D port of the first four-way valve 50 and is led to the second external pipe P2 through the E port of the first four-way valve 50. The refrigerant that has passed the indoor unit 1*b* may pass the expansion valve 70 of the outdoor unit 1*a* and then flow in through the upper outlet 102 of the outdoor heat exchanger 100 along the upper outlet pipe 120. The upper portion of the outdoor heat exchanger 100 operates as an evaporator that absorbs heat. The refrigerant flowing in through the upper outlet 102 of the outdoor heat exchanger 100 is moved to the first four-way valve 50 through the upper inlet 101. The refrigerant that has passed the first four-way valve 50 may go into the accumulator 80 along the suction line P4.

Furthermore, the high temperature and high pressure gaseous refrigerant discharged from the compressor 40 flows in through the D port (the first port) of the second sour-way valve 60 and is led to the lower portion of the outdoor heat exchanger 100 through the C port (the third port) of the second four-way valve 60. In other words, the high temperature and high pressure gaseous refrigerant may be supplied to the lower inlet 201 of the outdoor heat exchanger 100 through the lower inlet pipe 210. Hence, heat is emitted in the lower portion of the outdoor heat exchanger 100 and the lower portion of the outdoor heat exchanger 100 may be defrosted. The refrigerant flowing in through the lower inlet 201 of the outdoor heat exchanger 100 may be discharged through the lower outlet 202 and moved to the upper outlet 102 of the outdoor heat exchanger 100 along the lower outlet pipe 220. In other words, the refrigerant discharged from the lower outlet 202 of the outdoor heat exchanger 100 may join the refrigerant moved to the upper outlet 102 of the outdoor heat exchanger 100 along the upper outlet pipe 120.

As such, with the lower portion of the outdoor heat exchanger 100 operating as a condenser while the upper portion of the outdoor heat exchanger 100 operating as an evaporator, both defrosting performance and heating performance may be improved. Furthermore, as both the upper portion and the lower portion of the outdoor heat exchanger 100 are used even when the air conditioner 1 performs a normal cooling operation or heating operation, the cooling performance and the heating performance may be improved.

Figure 10:
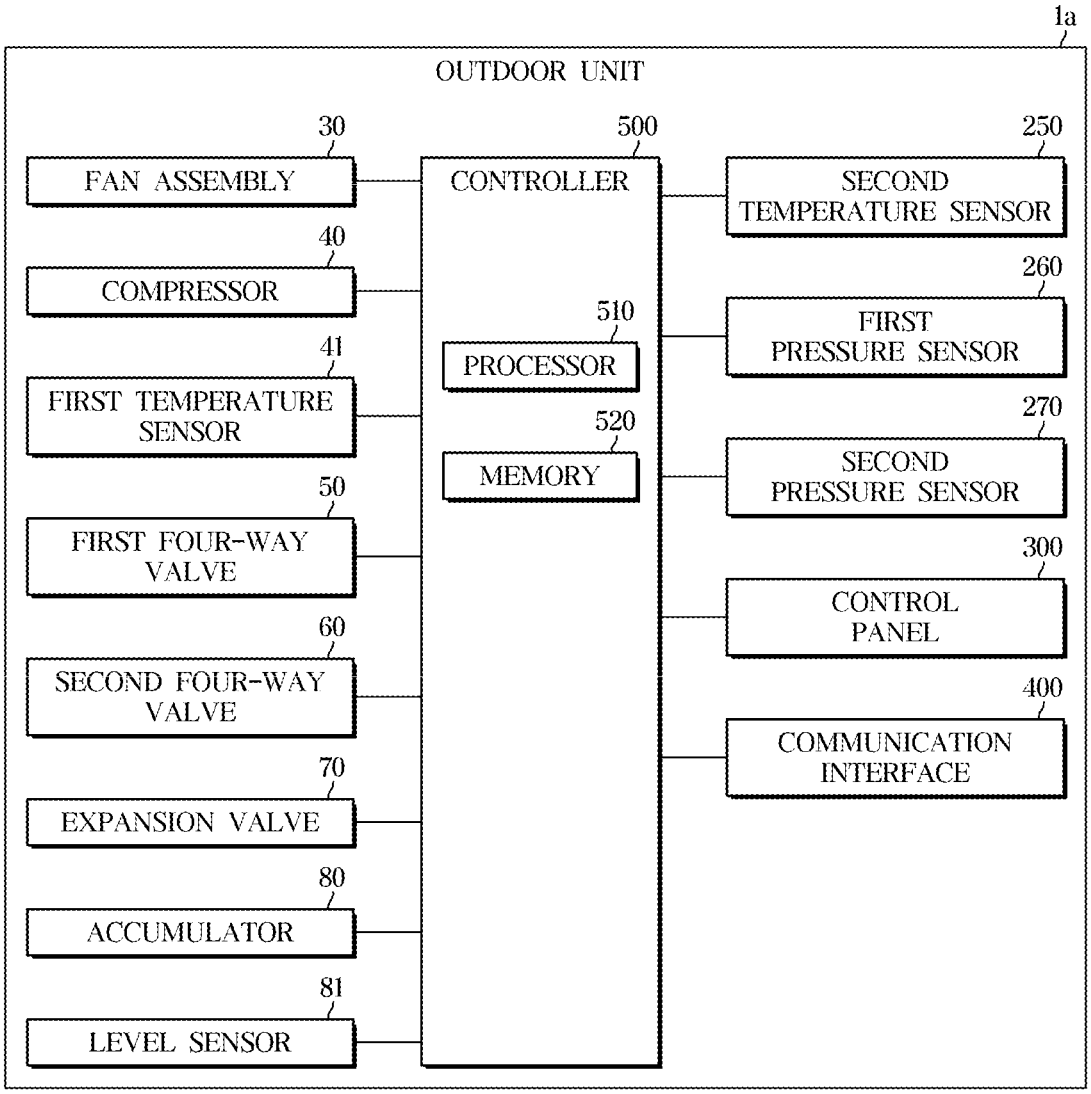
FIG. 10 is a control block diagram of an air conditioner, according to an embodiment of the disclosure.

FIG. 10 is a control block diagram of an air conditioner, according to an embodiment of the disclosure.

Referring to FIG. 10, the outdoor unit 1*a* of the air conditioner 1 may include the fan assembly 30, the compressor 40, the first temperature sensor 41, the first four-way valve 50, the second four-way valve 60, the expansion valve 70, the accumulator 80, the level sensor 81, the second temperature sensor 250, the first pressure sensor 260, the second pressure sensor 270, a control panel 300, a communication interface 400 and a controller 500. The controller 500 may be electrically connected to the components of the outdoor unit 1*a* to control the respective components.

For example, the controller 500 may control the compressor 40 to control the operation frequency, control the first four-way valve 50 and/or the second four-way valve 60 to change a circulation direction of the refrigerant, and control an opening degree of the expansion valve 70. Furthermore, the controller 500 may control rotation speed of the fan assembly 30. The rotation speed of the fan assembly 30 may be controlled according to outdoor temperature.

The compressor 40 may discharge the high temperature and high pressure gaseous refrigerant in response to a control signal of the controller 500. The refrigerant discharged from the compressor 40 may be circulated along a refrigerant flow path including the first four-way valve 50, the second four-way valve 60, the outdoor heat exchanger 100, the expansion valve 70, the indoor unit 1*b* and the accumulator 80. The compressor 40 may compress the gaseous refrigerant and discharge the high temperature and high pressure gaseous refrigerant.

The first temperature sensor 41 may detect temperature at the discharge port of the compressor 40. The first temperature sensor 41 may transmit an electrical signal corresponding to the temperature at the discharge port of the compressor 40 to the controller 500. The controller 500 may forcedly terminate the main defrosting operation based on the temperature at the discharge port of the compressor 40 exceeding a preset reference temperature.

The first four-way valve 50 may change the circulation direction of the refrigerant discharged from the compressor 40 under the control of the controller 500. In the cooling operation or main defrosting operation, the first four-way valve 50 leads the refrigerant compressed by the compressor 40 to the outdoor heat exchanger 100. In the heating operation or sub-defrosting operation, the first four-way valve 50 leads the refrigerant compressed by the compressor 40 to the indoor unit 1*b*.

The second four-way valve 60 may lead the refrigerant compressed by the compressor 40 to the lower portion of the outdoor heat exchanger 100 or lead the refrigerant discharged from the lower portion of the outdoor heat exchanger 100 to the accumulator 80, under the control of the controller 500.

The expansion valve 70 may decompress the refrigerant. Furthermore, the expansion valve 70 may regulate an amount of the refrigerant supplied to sufficiently exchange heat in the outdoor heat exchanger 100 or in the indoor heat exchanger of the indoor unit 1*b*. The expansion valve 70 decompresses the refrigerant by using throttling actions of the refrigerant. The controller 500 may control the expansion valve 70 to be opened or closed and control the opening degree of the expansion valve 70.

The accumulator 80 may separate the gaseous refrigerant from the liquid refrigerant, and prevent the liquid refrigerant from flowing into the compressor 40. The accumulator 80 may include the level sensor 81. The level sensor 81 may detect a level of the liquid refrigerant stored in the accumulator 80. The accumulator 80 may include components to evaporate the liquid refrigerant. Based on the level of the liquid refrigerant detected by the level sensor 81 becoming higher than a preset reference level, the controller 500 may determine that the liquid refrigerant has flowed into the compressor 40. The controller 500 may terminate operation of the compressor 40 when the inflow of the liquid refrigerant to the compressor 40 is detected. Furthermore, the controller 500 may control the accumulator 80 to evaporate the liquid refrigerant.

The second temperature sensor 250 may detect a temperature of the refrigerant discharged from the lower outlet 201 of the outdoor heat exchanger 100. The second temperature sensor 250 may be installed in the lower outlet pipe 220 connected to the lower outlet 201 of the outdoor heat exchanger 100. The second temperature sensor 250 may transmit an electrical signal corresponding to the temperature in the lower portion of the outdoor heat exchanger 100 to the controller 500. The controller 500 may enter into the sub-defrosting operation based on the temperature in the lower portion of the outdoor heat exchanger 100 detected at a time of termination of the main defrosting operation being lower than a preset threshold temperature.

The first pressure sensor 260 may detect pressure of the refrigerant flowing in the discharge line P3. The first pressure sensor 260 may be arranged between the compressor 40 and the first four-way valve 50. The first pressure sensor 260 may be installed in the discharge line P3 connected to the discharge port of the compressor 40. The first pressure sensor 260 may transmit an electrical signal corresponding to a detected first pressure value to the controller 500.

The second pressure sensor 270 may detect pressure of the refrigerant flowing in the suction line P4. The second pressure sensor 270 may be arranged between the first four-way valve 50 and the accumulator 80. The second pressure sensor 270 may be installed in the suction line P4 connected to the suction port of the accumulator 80. The second pressure sensor 270 may transmit an electrical signal corresponding to a detected second pressure value to the controller 500.

The control panel 300 may be provided on one surface of the cabinet 10 of the outdoor unit 1*a*. The control panel 300 may obtain a user input related to an operation of the air conditioner 1 and output information about the operation of the air conditioner 1. The control panel 300 may transmit an electrical signal (voltage or current) corresponding to the user input to the controller 500. The controller 500 may control an operation of the air conditioner 1 based on the electrical signal transmitted from the control panel 300.

The control panel 300 may include a plurality of buttons. For example, the plurality of buttons may include a membrane switch, a push switch activated by the pressure of the user and/or a touch switch activated by a touch of a body part of the user. As an example of the plurality of buttons, a test run button (not shown) for inputting a test run command to the air conditioner 1 may be provided.

Furthermore, the control panel 300 may include a display. The control panel 300 may display information input by the user or information to be provided for the user in various screens. For example, the control panel 300 may output information such as a message of an error occurring in the test run process of the air conditioner 1, a test run progress, or a test-run result through the display.

The control panel 300 may include a display panel of various types. For example, the control panel 300 may include a liquid crystal display (LCD) panel, a light emitting diode (LED) panel, an organic LED (OLED) panel, or a micro LED panel. The control panel 300 may be implemented with a touch display. The touch display may include a display panel for displaying an image and a touch panel for receiving a touch input. When the control panel 300 is provided as the touch display, extra buttons may be omitted.

The communication interface 400 may perform communication with the indoor unit 1*b*. The communication interface 400 of the outdoor unit 1*a* may transmit a control signal sent from the controller 500 to the indoor unit 1*b* or send a control signal transmitted from the indoor unit 1*b* to a processor 510. In other words, the outdoor unit 1*a* and the indoor unit 1*b* may perform bi-directional communication.

The outdoor unit 1*a* and the indoor unit 1*b* may transmit or receive various signals during operation.

The controller 500 may perform the main defrosting operation to defrost the whole outdoor heat exchanger 100 during the heating operation. The controller 500 may perform the main defrosting operation based on frost formation on the outdoor heat exchanger 100 during the heating operation. The main defrosting operation may also be referred to as the first defrosting operation. The frost formation may be determined based on the temperature of the outdoor heat exchanger 100. For example, when the temperature in the lower portion of the outdoor heat exchanger 100 detected by the second temperature sensor 250 is equal to or lower than a preset frost formation temperature, the controller 500 may determine that frost is formed.

The controller 500 may temporarily stop the heating operation to perform the main defrosting operation. The controller 500 may temporarily stop the operation of the compressor 40, and control the first four-way valve 50 and the second four-way valve 60 to change a circulation direction of the refrigerant. The controller 500 may switch the first four-way valve 50 and the second four-way valve 60 in response to the start of the main defrosting operation so that the refrigerant flows in through the upper inlet 101 and the lower inlet 201 of the outdoor heat exchanger 100.

When the compressor 40 operates again, the refrigerant flows from the compressor 40 to the outdoor heat exchanger 100. With the inflow of high temperature and high pressure refrigerant, the outdoor heat exchanger 100 may emit heat and the heat may remove the frost formed on the surface of the outdoor heat exchanger 100.

The controller 500 may determine whether to perform the sub-defrosting operation for additionally defrosting the lower portion of the outdoor heat exchanger 100 based on termination of the main defrosting operation. The sub-defrosting operation may be referred to as the second defrosting operation. For example, the main defrosting operation may be performed for a preset reference defrosting time, e.g., 12 minutes. The reference defrosting time may refer to a maximum defrosting time of the main defrosting operation. The controller 500 may terminate the main defrosting operation based on the lapse of the preset reference defrosting time. The controller 500 may enter into the sub-defrosting operation based on the temperature in the lower portion of the outdoor heat exchanger 100 detected at a time of completion of the main defrosting operation being lower than a preset threshold temperature. When the temperature in the lower portion of the outdoor heat exchanger 100 is lower than the threshold temperature even after the main defrosting operation is performed for the reference defrosting time, it may be determined that the frost removal by the main defrosting operation is incomplete. Hence, the sub-defrosting operation may be performed to further defrost the lower portion of the outdoor heat exchanger 100.

In another example, the controller 500 may enter into the sub-defrosting operation based on forced termination of the main defrosting operation according to a preset compressor protection condition. The compressor protection condition is a condition related to breakdown or damage of the compressor 40. When the compressor protection condition is satisfied, operation of the compressor 40 may be terminated to protect the compressor 40. The compressor protection condition may be about a liquid refrigerant flowing into the compressor 40, a current applied to the compressor 40 exceeding a reference current, or a temperature at the discharge port of the compressor 40 exceeding a reference temperature.

The controller 500 may forcedly terminate the main defrosting operation based on detection of inflow of a liquid refrigerant to the compressor 40, a current applied to the compressor 40 exceeding the reference current, or a temperature at the discharge port of the compressor 40 exceeding the reference temperature. The controller 500 may detect a current applied to the compressor 40 and control the current applied to the compressor 40. The main defrosting operation may be forcedly terminated according to the compressor protection condition before the lapse of a reference defrosting time for which the main defrosting operation is performed. In this case, defrosting of the outdoor heat exchanger 100 may be incomplete, so the sub-defrosting operation may be performed. The sub-defrosting operation may be performed after compressor protection according to the compressor protection condition being released.

The controller 500 may control the first four-way valve 50 and the second four-way valve 60 so that the upper portion of the outdoor heat exchanger 100 is operated as an evaporator and the lower portion of the outdoor heat exchanger 100 is operated as a condenser in the sub-defrosting operation. The controller 500 may switch the first four-way valve 50 for the refrigerant to be discharged from the upper inlet 101 of the outdoor heat exchanger 100 in response to the start of the sub-defrosting operation. As the second four-way valve 60 is in a switched state for supplying the refrigerant to the lower inlet 201 of the outdoor heat exchanger 100 when the main defrosting operation is started, the second four-way valve 60 is controlled not to be switched again when there is a change from the main defrosting operation to the sub-defrosting operation.

The controller 500 may terminate the sub-defrosting operation based on a condition to terminate the sub-defrosting operation, and then perform the heating operation again. For example, the controller 500 may terminate the sub-defrosting operation based on the lapse of a preset additional defrosting time, e.g., 6 minutes, and switch the second four-way valve to return to the heating operation. In another example, the controller 500 may terminate the sub-defrosting operation based on a difference between a first pressure value of the first pressure sensor 260 and a second pressure value of the second pressure sensor 270 being equal to or greater than a preset threshold, e.g., 20 kgf/cm$^2$, and switch the second four-way valve 60 for returning to the heating operation.

As such, with the lower portion of the outdoor heat exchanger 100 operating as a condenser while the upper portion of the outdoor heat exchanger 100 is operating as an evaporator, both defrosting performance and heating performance may be improved. Furthermore, as both the upper portion and the lower portion of the outdoor heat exchanger 100 are used even when the air conditioner 1 performs a normal cooling operation or heating operation, the cooling performance and the heating performance may be improved.

The controller 500 may include the processor 510 and a memory 520. The processor 510 may generate control signals for controlling operation of the air conditioner 1 based on instructions, an application, data and/or a program stored in the memory 520. The processor 510 may include logic circuits and operation circuits in hardware. The processor 510 may process data according to the program and/or instructions provided from the memory 520 and generate a control signal based on the processing result. The memory 520 and the processor 510 may be implemented in one control circuit or in multiple circuits.

The memory 520 may memorize/store various information required for operation of the air conditioner 1. The memory 520 may store instructions, an application, data and/or a program required for operation of the air conditioner 1. For example, the memory 520 may store a program for a test run of the air conditioner 1.

The memory 520 may include a volatile memory such as a static random access memory (S-RAM), dynamic RAM (D-RAM), etc., for temporarily storing data, and a non-volatile memory such as a read only memory (ROM), an erasable programmable ROM (EPROM), an electrically erasable programmable (ROM) (EEPROM), etc., for storing data for a long time.

Some of the aforementioned components of the outdoor unit 1*a* may be omitted, or other components may be added in addition to the aforementioned components of the outdoor unit 1*a*. It will be obvious to those of ordinary skill in the art that the relative positions of the components may be changed to correspond to the system performance or structure.

Figure 11:
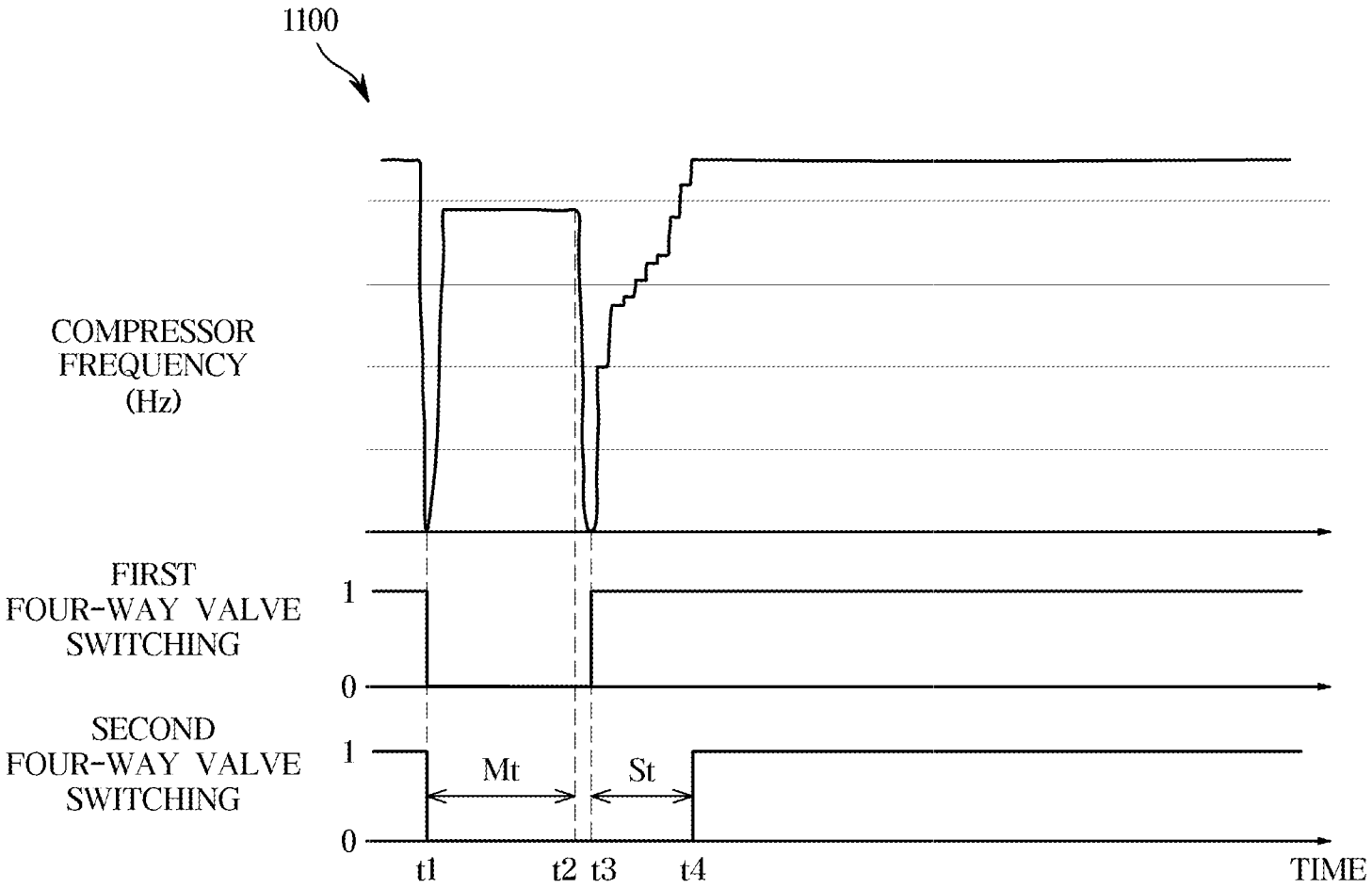
FIG. 11 is graphs representing operations of a compressor and four-way valves when a defrosting operation is performed during a heating operation according to an embodiment of the disclosure.

FIG. 11 is a graph 1100 representing operations of a compressor and four-way valves when a defrosting operation is performed during a heating operation.

Referring to the graph 1100 of FIG. 11, the controller 500 of the air conditioner 1 may perform the main defrosting operation to defrost the whole heat exchanger 100 during the heating operation. The controller 500 may perform the main defrosting operation based on frost/ice formation in the outdoor heat exchanger 100 during the heating operation.

The controller 500 may start the main defrosting operation at time t1. The controller 500 may terminate the heating operation for the main defrosting operation, and switch the first four-way valve 50 and the second four-way valve 60. The controller 500 may terminate the operation of the compressor 40 and operate the compressor 40 again to make a change from the heating operation to the main defrosting operation. The main defrosting operation may be performed for a preset reference defrosting time Mt.

The controller 500 may terminate the main defrosting operation at time t2 at which the reference defrosting time has elapsed, and determine whether to perform the sub-defrosting operation for additionally defrosting the lower portion of the outdoor heat exchanger 100. The controller 500 may determine whether to perform the sub-defrosting operation based on the temperature in the lower portion of the outdoor heat exchanger 100 detected at a time of termination of the main defrosting operation (time t2) being lower than the preset threshold temperature. At the time t2 at which the main defrosting operation is terminated, operation of the compressor 40 may be temporarily terminated.

In the meantime, the main defrosting operation may happen to be terminated before the reference defrosting time passes. The controller 500 may forcedly terminate the main defrosting operation when the preset compressor protection condition is detected during the main defrosting operation. When the main defrosting operation is forcedly terminated at time t2, a time length from time t1 to time t2 may be shorter than the reference defrosting time. In this case, defrosting of the outdoor heat exchanger 100 may be incomplete, so the sub-defrosting operation may be performed.

The controller 500 may start the sub-defrosting operation at time t3. The controller 500 may switch the first four-way valve 50, and operate the compressor 40 again. As the first four-way valve 50 is switched, the refrigerant may be discharged from the upper inlet 101 of the outdoor heat exchanger 100. As the second four-way valve 60 is in a switched state for supplying the refrigerant to the lower inlet 201 of the outdoor heat exchanger 100 when the main defrosting operation is started, the second four-way valve 60 is controlled not to be switched again when there is a change from the main defrosting operation to the sub-defrosting operation.

The controller 500 may terminate the sub-defrosting operation at time t4, and switch the second four-way valve 60 to return to the heating operation. For example, the sub-defrosting operation may be performed for a preset additional defrosting time St. The controller 500 may terminate the sub-defrosting operation based on the lapse of the preset additional defrosting time, and switch the second four-way valve 60. In another example, the controller 500 may terminate the sub-defrosting operation based on a difference between a first pressure value of the first pressure sensor 260 and a second pressure value of the second pressure sensor 270 being equal to or greater than a preset threshold, e.g., 20 kgf/cm$^2$.

Figure 12:
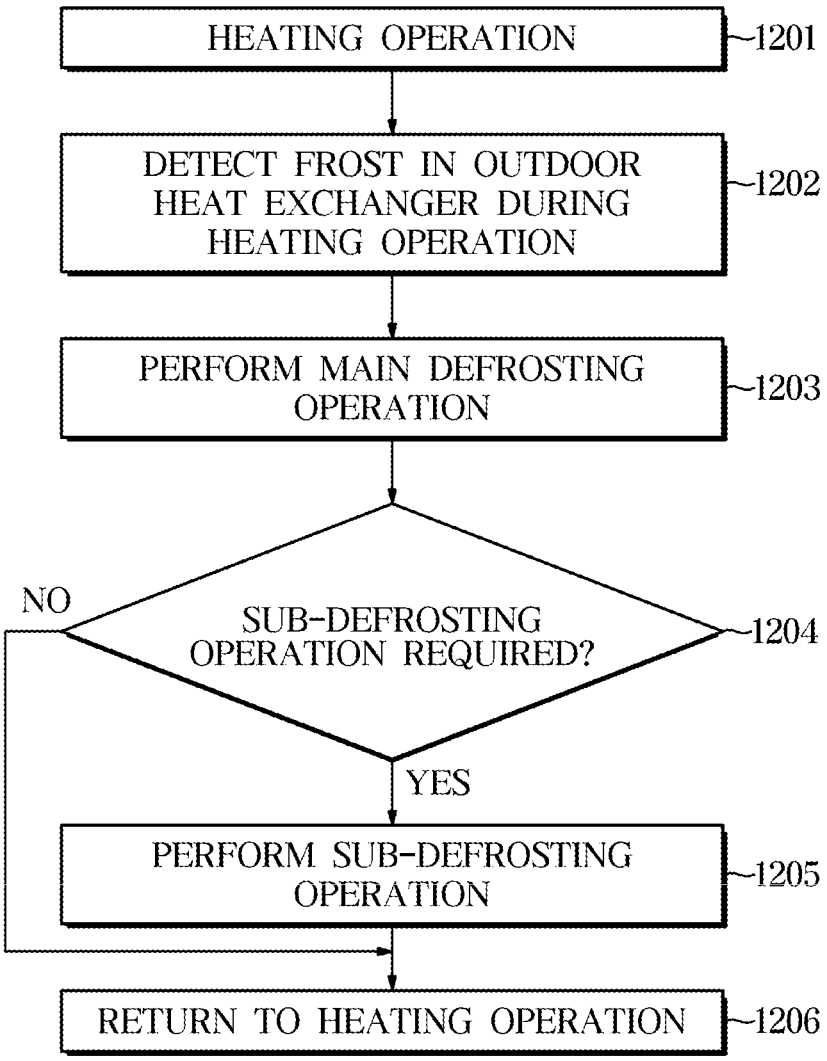
FIG. 12 is a flowchart describing a method of controlling an air conditioner, according to an embodiment of the disclosure.
Figure 13:
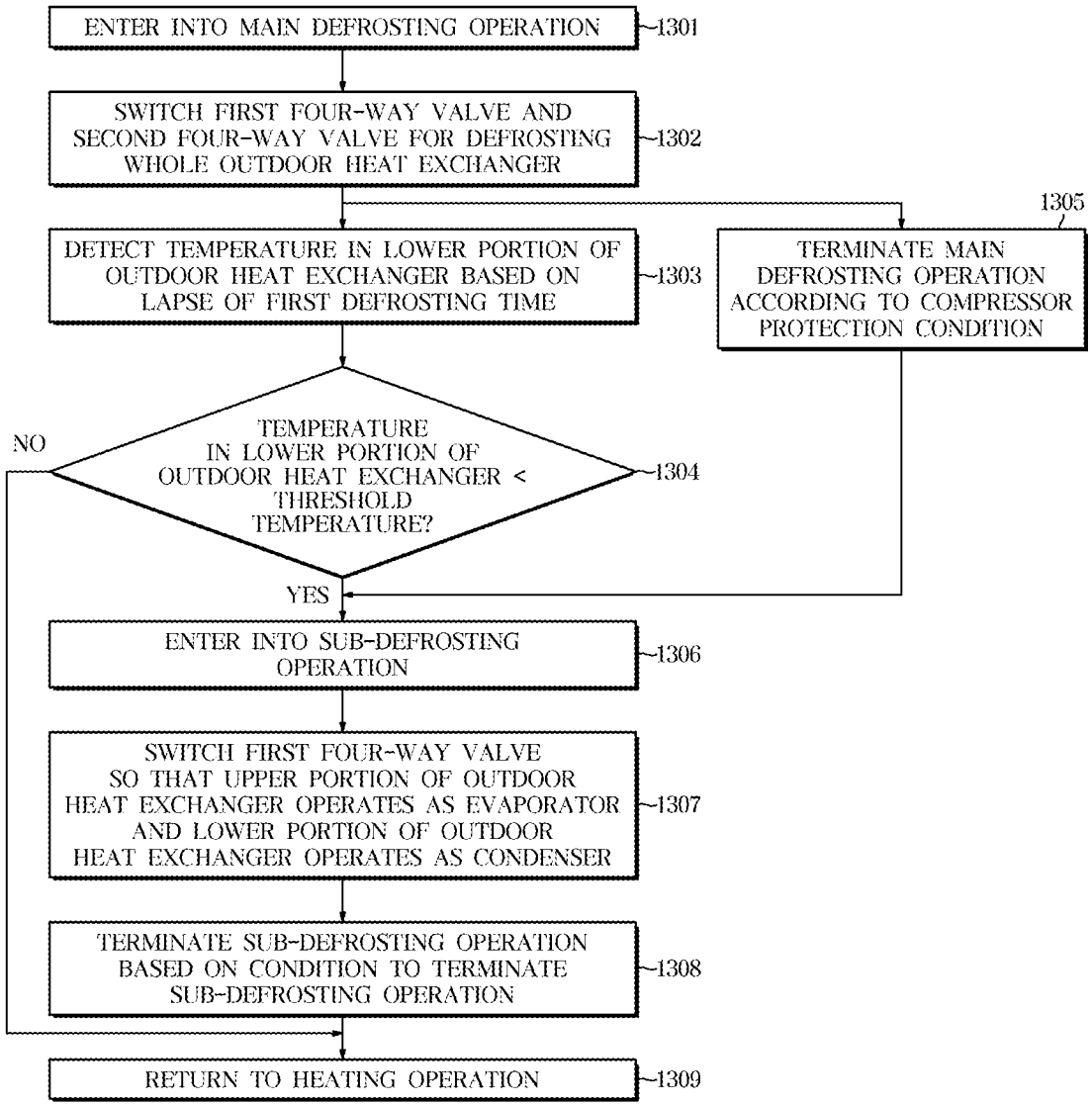
FIG. 13 is a flowchart illustrating the controlling method of FIG. 12 in more detail according to an embodiment of the disclosure.

FIG. 12 is a flowchart describing a method of controlling an air conditioner, according to an embodiment of the disclosure. FIG. 13 is a flowchart illustrating the controlling method of FIG. 12 in more detail.

Referring to FIG. 12, the controller 500 of the air conditioner 1 may perform a heating operation, in 1201. The heating operation may be performed according to a command input through the control panel 300 or based on a room temperature. The controller 500 may detect formation of frost in the outdoor heat exchanger 100 during the heating operation, in 1202. The frost formation may be determined based on the temperature of the outdoor heat exchanger 100. For example, when the temperature in the lower portion of the outdoor heat exchanger 100 detected by the second temperature sensor 250 is equal to or lower than a preset frost formation temperature, the controller 500 may determine that frost is formed.

The controller 500 may perform the main defrosting operation to defrost the whole outdoor heat exchanger 100, in 1203. The controller 500 may determine whether the sub-defrosting operation is required to additionally defrost the lower portion 100D of the outdoor heat exchanger 100 based on termination of the main defrosting operation, in 1204. When determining that additional defrosting is required for the lower portion 100D of the outdoor heat exchanger 100, the controller 500 may perform the sub-defrosting operation, in 1205. The controller 500 may terminate the sub-defrosting operation and then perform the heating operation again, in 1206.

Referring to FIG. 13, the controller 500 may enter into the main defrosting operation based on frost formation in the outdoor heat exchanger 100 during the heating operation, in 1301. The controller 500 may switch the first four-way valve 50 and the second four-way valve 60 so that the refrigerant flows in through the upper inlet 101 and the lower inlet 201 of the outdoor heat exchanger 100 for defrosting the whole outdoor heat exchanger 100, in 1302.

The controller 500 may detect the temperature in the lower portion of the outdoor heat exchanger 100 based on the lapse of a preset reference defrosting time, in 1303. The reference defrosting time may be referred to as a first defrosting time. The controller 500 may control the temperature sensor 250 installed in the lower outlet pipe 220 to detect the temperature in the lower portion of the outdoor heat exchanger 100. The controller 500 may determine whether the temperature in the lower portion of the outdoor heat exchanger 100 is lower than a preset threshold temperature, in 1304. The controller 500 may enter into the sub-defrosting operation based on the temperature in the lower portion of the outdoor heat exchanger 100 being lower than the preset threshold temperature, in 1306.

Alternately, the controller 500 may enter into the sub-defrosting operation based on forced termination of the main defrosting operation according to a preset compressor protection condition in 1305 and 1306. The compressor protection condition may be about a liquid refrigerant flowing into the compressor 40, a current applied to the compressor 40 exceeding a reference current, or a temperature at the discharge port of the compressor 40 exceeding a reference temperature.

The controller 500 may switch the first four-way valve 50 to operate the upper portion of the outdoor heat exchanger 100 as an evaporator and the lower portion of the outdoor heat exchanger 100 as a condenser in response to the start of the sub-defrosting operation, in 1307. As the first four-way valve 50 is switched, the refrigerant may flow in through the upper outlet 102 of the outdoor heat exchanger 100 and may then be discharged through the upper inlet 101. As the second four-way valve 50 remains the same, the refrigerant may flow in through the lower inlet 201 of the outdoor heat exchanger 100 and may then be discharged through the lower outlet 202.

The controller 500 may terminate the sub-defrosting operation based on a condition to terminate the sub-defrosting operation, and then perform the heating operation again, in 1308 and 1309. For example, the controller 500 may terminate the sub-defrosting operation based on the lapse of a preset additional defrosting time, e.g., 6 minutes, and switch the second four-way valve to return to the heating operation. In another example, the controller 500 may terminate the sub-defrosting operation based on a difference between a first pressure value of the first pressure sensor 260 and a second pressure value of the second pressure sensor 270 being equal to or greater than a preset threshold, e.g., 20 $kgf/cm^2$, and switch the second four-way valve 60 for returning to the heating operation.

As described above, an air conditioner and method for controlling the same as disclosed herein may effectively completely remove frost formed on an outdoor heat exchanger by performing a main defrosting operation to defrost the whole outdoor heat exchanger and a sub-defrosting operation to additionally defrost a lower portion of the outdoor heat exchanger.

The air conditioner and method for controlling the same as disclosed herein may enhance both defrosting performance and heating performance by operating the lower portion of the outdoor heat exchanger as a condenser to perform defrosting and simultaneously operating an upper portion of the outdoor heat exchanger as an evaporator.

Furthermore, the air conditioner and method for controlling the same as disclosed herein may improve cooling performance and heating performance by using both the upper portion and the lower portion of the outdoor heat exchanger in performing a normal cooling operation or even a heating operation.

Meanwhile, the embodiments of the disclosure may be implemented in the form of a storage medium for storing instructions to be carried out by a computer. The instructions may be stored in the form of program codes, and when executed by a processor, may generate program modules to perform operations in the embodiments of the disclosure.

The machine-readable storage medium may be provided in the form of a non-transitory storage medium. The term 'non-transitory storage medium' may mean a tangible device without including a signal, e.g., electromagnetic waves, and may not distinguish between storing data in the storage medium semi-permanently and temporarily. For example, the non-transitory storage medium may include a buffer that temporarily stores data.

The aforementioned methods according to the various embodiments of the disclosure may be provided in a computer program product. The computer program product may be a commercial product that may be traded between a seller and a buyer. The computer program product may be distributed in the form of a storage medium (e.g., a compact disc read only memory (CD-ROM)), through an application store (e.g., Play Store™), directly between two user devices (e.g., smart phones), or online (e.g., downloaded or uploaded). In the case of online distribution, at least part of the computer program product (e.g., a downloadable app) may be at least temporarily stored or arbitrarily created in a storage medium that may be readable to a device such as a server of the manufacturer, a server of the application store, or a relay server.

According to the disclosure, an air conditioner and method for controlling the same as disclosed herein may effectively completely remove frost formed on an outdoor heat exchanger by performing a main defrosting operation to defrost the whole outdoor heat exchanger and a sub-defrosting operation to additionally defrost a lower portion of the outdoor heat exchanger.

According to the disclosure, the air conditioner and method for controlling the same as disclosed herein may enhance both defrosting performance and heating performance by operating the lower portion of the outdoor heat exchanger as a condenser to perform defrosting and simultaneously operating an upper portion of the outdoor heat exchanger as an evaporator.

Furthermore, the air conditioner and method for controlling the same as disclosed herein may improve cooling performance and heating performance by using both the upper portion and the lower portion of the outdoor heat exchanger in performing a normal cooling operation or even a heating operation.

The embodiments of the disclosure have thus far been described with reference to accompanying drawings. It will be obvious to those of ordinary skill in the art that the disclosure may be practiced in other forms than the embodiments as described above without changing the technical idea or essential features of the disclosure. The above embodiments of the disclosure are only by way of example, and should not be construed in a limited sense.

What is claimed is:

1. An air conditioner comprising:

a compressor configured to compress a refrigerant, and including a discharge port;

an outdoor heat exchanger configured to exchange heat with outside air, and including:

an upper portion including an upper inlet, and a lower portion including a lower inlet;

a first four-way valve arranged between the discharge port of the compressor and the upper inlet;

a second four-way valve arranged between the discharge port of the compressor and the lower inlet; and a controller electrically connected to the compressor, the first four-way valve and the second four-way valve, wherein the controller is configured to:

control the first four-way valve and the second four-way valve to perform a first defrosting operation which defrosts the upper portion and the lower portion during a heating operation, and control the first four-way valve and the second four-way valve to perform a second defrosting operation which operates the upper portion as an evaporator, and operates the lower portion as a condenser, based on a need for additional defrosting of the lower portion being detected, wherein detecting the need for additional defrosting of the lower portion includes detecting a preset compressor protection condition including at least one of inflow of a liquid refrigerant to the compressor, a current supplied to the compressor exceeding a reference current, or temperature at the discharge port of the compressor exceeding a reference temperature.

2. The air conditioner of claim 1, wherein, the controller is configured to:

switch the first four-way valve and the second four-way valve so that refrigerant from the first four-way valve flows in through the upper inlet and refrigerant from the second four-way valve flows in through the lower inlet in response to starting the first defrosting operation, and switch the first four-way valve to discharge refrigerant from the upper inlet in response to starting the second defrosting operation.

3. The air conditioner of claim 1, wherein, the controller is configured to:

terminate the first defrosting operation based on a lapse of a preset reference defrosting time, and enter into the second defrosting operation based on a temperature of the lower portion detected at a time of termination of the first defrosting operation being lower than a preset threshold temperature.

4. The air conditioner of claim 1, wherein, the controller is configured to:

enter into the second defrosting operation based on a forced termination of the first defrosting operation occurring according to the preset compressor protection condition.

5. The air conditioner of claim 4, wherein, the controller is configured to:

forcedly terminate the first defrosting operation based on detection of inflow of the liquid refrigerant to the compressor, the current applied to the compressor exceeding the reference current, or temperature at the discharge port of the compressor exceeding the reference temperature.

6. The air conditioner of claim 1, wherein, the controller is configured to:

terminate the second defrosting operation based on a lapse of a preset additional defrosting time, and switch the second four-way valve to return to the heating operation.

7. The air conditioner of claim 1, further comprising:

an accumulator;

a first pressure sensor arranged between the compressor and the first four-way valve; and a second pressure sensor arranged between the first four-way valve and the accumulator, wherein the controller is configured to:

terminate the second defrosting operation based on a difference between a first pressure value of the first pressure sensor and a second pressure value of the second pressure sensor being equal to or greater than a preset threshold, and switch the second four-way valve to return to the heating operation.

8. The air conditioner of claim 1, further comprising:

an accumulator, wherein the second four-way valve includes:

a first port connected to the discharge port of the compressor;

a second port connected to a suction port of the accumulator;

a third port connected to the lower inlet; and a closed fourth port.

9. The air conditioner of claim 1, wherein, the lower portion includes:

a lower outlet through which a refrigerant brought in through the lower inlet is discharged, and a lower refrigerant tube connecting the lower inlet to the lower outlet, and the upper portion includes:

an upper outlet arranged above the lower outlet and through which a refrigerant brought in through the upper inlet is discharged, and an upper refrigerant tube connecting the upper inlet to the upper outlet.

10. The air conditioner of claim 9, wherein, the outdoor heat exchanger includes:

an upper inlet pipe connecting the upper inlet to the first four-way valve;

a lower inlet pipe connecting the lower inlet to the second four-way valve;

a lower outlet pipe connected to the lower outlet; and an upper outlet pipe connected to the upper outlet and the lower outlet pipe.

11. The air conditioner of claim 10, wherein, the outdoor heat exchanger includes:

a temperature sensor installed in the lower outlet pipe and configured to detect a temperature of the refrigerant discharged from the lower outlet.

12. A method of controlling an air conditioner including a first four-way valve arranged between a discharge port of a compressor and an upper inlet of an outdoor heat exchanger, and a second four-way valve arranged between the discharge port of the compressor and a lower inlet of the outdoor heat exchanger, the method comprising:

controlling the first four-way valve and the second four-way valve to perform a first defrosting operation to defrost an upper portion of the outdoor heat exchanger and a lower portion of the outdoor heat exchanger during a heating operation;

determining whether to perform a second defrosting operation to additionally defrost the lower portion of the outdoor heat exchanger based on termination of the first defrosting operation; and controlling the first four-way valve and the second four-way valve so that the upper portion of the outdoor heat exchanger operates as an evaporator, and the lower portion of the outdoor heat exchanger operates as a condenser, in the second defrosting operation, wherein determining whether to perform a second defrosting operation includes performing a second defrosting operation which defrosts the lower portion based on a need for additional defrosting of the lower portion being detected, and wherein detecting the need for additional defrosting of the lower portion includes detecting a preset compressor protection condition including at least one of inflow of a liquid refrigerant to the compressor, a current supplied to the compressor exceeding a reference current, or temperature at the discharge port of the compressor exceeding a reference temperature.

13. The method of claim 12, wherein the controlling of the first four-way valve and the second four-way valve includes:

switching the first four-way valve and the second four-way valve so that refrigerant from the first four-way valve flows in through the upper inlet of the outdoor heat exchanger and refrigerant from the second four-way valve flows in through the lower inlet of the outdoor heat exchanger in response to starting the first defrosting operation; and switching the first four-way valve to discharge refrigerant from the upper inlet of the outdoor heat exchanger in response to starting the second defrosting operation.

14. The method of claim 12, wherein, the determining of whether to perform the second defrosting operation includes:

terminating the first defrosting operation based on a lapse of a preset reference defrosting time; and entering into the second defrosting operation based on a temperature of a lower portion of the outdoor heat exchanger detected at a time of termination of the first defrosting operation being lower than a preset threshold temperature.

15. The air conditioner of claim 12, wherein, the determining of whether to perform the second defrosting operation includes:

entering into the second defrosting operation based on a forced termination of the first defrosting operation occurring according to a preset compressor protection condition.

16. An air conditioner comprising:

a compressor configured to compress a refrigerant, and including a discharge port;

an outdoor heat exchanger configured to exchange heat with outside air, and including:

an upper portion, an upper inlet, a lower portion, and a lower inlet;

a first four-way valve arranged between the discharge port of the compressor and the upper inlet;

a second four-way valve arranged between the discharge port of the compressor and the lower inlet; and a controller electrically connected to the compressor, the first four-way valve and the second four-way valve, wherein the controller is configured to:

control the first four-way valve so that refrigerant from the first four-way valve flows to the upper inlet, and control the second four-way valve so that refrigerant from the second four-way valve flows to the lower inlet, to perform a first defrosting operation which defrosts the upper portion and the lower portion during a heating operation, and control the first four-way valve to discharge refrigerant from the upper inlet, and control the second four-way valve so that the refrigerant from the second four-way valve flows to the lower inlet, to perform a second defrosting operation which defrosts the lower portion, based on a need for additional defrosting of the lower portion, wherein detecting the need for additional defrosting of the lower portion includes detecting a preset compressor protection condition including at least one of inflow of a liquid refrigerant to the compressor, a current supplied to the compressor exceeding a reference current, or temperature at the discharge port of the compressor exceeding a reference temperature.

* * * * *